US009045693B2

(12) United States Patent
Wolfe

(10) Patent No.: US 9,045,693 B2
(45) Date of Patent: Jun. 2, 2015

(54) PYROLYZER FURNACE APPARATUS AND METHOD FOR OPERATION THEREOF

(75) Inventor: Richard A. Wolfe, Banner Elk, NC (US)

(73) Assignee: Nucor Corporation, Charlotte, NC (US)

( * ) Notice: Subject to any disclaimer, the term of this patent is extended or adjusted under 35 U.S.C. 154(b) by 216 days.

(21) Appl. No.: 13/608,703

(22) Filed: Sep. 10, 2012

(65) Prior Publication Data

US 2013/0240343 A1 Sep. 19, 2013

Related U.S. Application Data

(63) Continuation-in-part of application No. 11/959,581, filed on Dec. 19, 2007, now Pat. No. 8,444,828.

(60) Provisional application No. 60/871,863, filed on Dec. 26, 2006.

(51) Int. Cl.
*C10B 7/10* (2006.01)
*C10B 47/44* (2006.01)
(Continued)

(52) U.S. Cl.
CPC ..... *C10B 49/10* (2013.01); *C10J 3/007* (2013.01); *C10B 47/44* (2013.01); *F23G 5/0273* (2013.01);
(Continued)

(58) Field of Classification Search
CPC ..... C10B 7/10; C10B 47/44; C10B 49/10; C10J 3/007; C10J 2200/156; C10J 2300/0909; C10J 2300/093; C10J 2300/0973; C10J 2300/1223; C10J 2300/1246; C10J 2300/1207; F23G 5/0273; F23G 2201/303; F23G 2203/8013
USPC ..... 202/118; 432/114; 110/257; 165/87
See application file for complete search history.

(56) References Cited

U.S. PATENT DOCUMENTS 1,276,428 A 8/1918 Smith
1,415,061 A 5/1922 Smith et al.
(Continued)

FOREIGN PATENT DOCUMENTS

CA 579100 7/1959
CA 709336 5/1965
(Continued)

OTHER PUBLICATIONS

Wolfe, Richard A., Briefing Package on ICH-Wolfe Technology to produce a High Carbon Char Product from Bituminous Coal, Jul. 12, 2005.
(Continued)

*Primary Examiner* — Jill Warden
*Assistant Examiner* — Joye L Woodard
(74) *Attorney, Agent, or Firm* — Hahn, Loeser & Parks, LLP; Arland T. Stein

(57) ABSTRACT

A char making apparatus comprises a longitudinal pyrolyzer furnace housing wherein coal-bearing material may be heated to a temperature to fluidize volatile materials therein and plasticize coal in the coal-bearing material. At least two rotatable drive screws are laterally positioned and interleaved within the longitudinal furnace housing and capable of conveying coal-bearing materials through the pyrolyzer furnace housing, each drive screw having a hollow drive shaft and a diverter positioned within the drive shaft to provide heating to the coal-bearing material. A heating jacket about the longitudinal furnace housing provides additional heating to the coal-bearing material. Multiple combustion chambers adjacent the heating jacket and hollow drive shaft burn fluidized volatile materials and exhaust combustion fluids through the jacket and shaft.

37 Claims, 23 Drawing Sheets

(51) Int. Cl.
*C10B 49/10* (2006.01)
*C10J 3/00* (2006.01)
*F23G 5/027* (2006.01)

(52) U.S. Cl.
CPC .... *C10J 2300/0909* (2013.01); *C10J 2300/093* (2013.01); *C10J 2300/0973* (2013.01); *C10J 2300/1207* (2013.01); *C10J 2300/1223* (2013.01); *C10J 2300/1246* (2013.01); *F23G 2201/303* (2013.01); *F23G 2203/8013* (2013.01); *C10J 2200/156* (2013.01)

(56) References Cited

U.S. PATENT DOCUMENTS

| | | | |
|---|---|---|---|
| 1,468,379 | A | 9/1923 | Easton |
| 1,481,627 | A | 1/1924 | Smith |
| 1,595,933 | A | 8/1926 | Hayes |
| 1,595,934 | A | 8/1926 | Hayes |
| 1,662,575 | A | 3/1928 | Hayes |
| 1,669,023 | A | 5/1928 | Runge |
| 1,669,024 | A | 5/1928 | Runge |
| 1,712,840 | A | 5/1929 | Laucks |
| 1,713,840 | A | 5/1929 | Laucks |
| 1,723,932 | A | 8/1929 | Greene et al. |
| 1,751,127 | A | 3/1930 | Cantieny |
| 1,770,636 | A | 7/1930 | Von Radolin et al. |
| 1,771,999 | A | 8/1930 | Greene et al. |
| 1,775,323 | A | 9/1930 | Runge |
| 1,783,982 | A | 12/1930 | Runge et al. |
| 1,797,796 | A | 3/1931 | Runge |
| 1,805,109 | A | 5/1931 | Runge et al. |
| 1,810,828 | A | 6/1931 | Hayes |
| 1,881,826 | A | 10/1932 | McQuade |
| 1,921,993 | A | 8/1933 | McQuade |
| 1,923,209 | A | 8/1933 | Illingworth |
| 1,972,929 | A | 9/1934 | Fisher |
| 2,287,437 | A | 6/1942 | Lesher et al. |
| 2,357,621 | A | 9/1944 | Tuttle |
| 2,638,889 | A | 5/1953 | Dow et al. |
| 2,998,375 | A | 8/1961 | Peterson et al. |
| 3,023,456 | A | 3/1962 | Palfey |
| 3,051,629 | A | 8/1962 | Gorin et al. |
| 3,082,816 | A | 3/1963 | Skidmore |
| 3,177,128 | A | 4/1965 | Vartanian |
| 3,178,361 | A | 4/1965 | Bailey |
| 3,184,293 | A | 5/1965 | Work et al. |
| 3,251,751 | A | 5/1966 | Lindahl et al. |
| 3,401,089 | A | 9/1968 | Friedrich et al. |
| 3,525,124 | A | 8/1970 | Ocker |
| 3,548,926 | A | 12/1970 | Archer |
| 3,591,462 | A | 6/1971 | Bretz |
| 3,658,654 | A | 4/1972 | Gutberlet |
| 3,787,292 | A | 1/1974 | Keappler |
| 3,976,548 | A | 8/1976 | Kevorkian et al. |
| 4,033,728 | A | 7/1977 | Aoki et al. |
| 4,077,868 | A | 3/1978 | Chambers |
| 4,084,521 | A | 4/1978 | Herbold et al. |
| 4,094,746 | A | 6/1978 | Masciantonio et al. |
| 4,094,769 | A | 6/1978 | Brown |
| 4,098,649 | A | 7/1978 | Redker |
| 4,106,997 | A | 8/1978 | Kevorkian et al. |
| 4,140,478 | A | 2/1979 | Kawakami et al. |
| 4,202,734 | A | 5/1980 | Greenbaum |
| 4,206,713 | A | 6/1980 | Ryason |
| 4,235,676 | A | 11/1980 | Chambers |
| 4,308,103 | A | 12/1981 | Rotter |
| 4,366,026 | A | 12/1982 | Leyendecker |
| 4,374,704 | A | 2/1983 | Young |
| 4,395,309 | A | 7/1983 | Esztergar |
| 4,398,471 | A | 8/1983 | Thomanetz |
| 4,399,906 | A | 8/1983 | Millsap |
| 4,439,306 | A | 3/1984 | Voetter et al. |
| 4,466,809 | A | 8/1984 | Kissel et al. |
| 4,483,257 | A | 11/1984 | den Otter |
| 4,492,771 | A | 1/1985 | Hasegawa et al. |
| 4,583,995 | A | 4/1986 | Winckler et al. |
| 4,584,060 | A | 4/1986 | Winckler et al. |
| 4,671,800 | A | 6/1987 | Meyer et al. |
| 4,686,008 | A | 8/1987 | Gibson |
| 4,704,134 | A | 11/1987 | Meyer et al. |
| 4,705,603 | A | 11/1987 | McMullen et al. |
| 4,844,153 | A | 7/1989 | Mellsjo |
| 4,908,104 | A | 3/1990 | Loomans et al. |
| 5,017,269 | A | 5/1991 | Loomans et al. |
| 5,057,189 | A | 10/1991 | Apffel |
| 5,082,534 | A | 1/1992 | Breu |
| 5,151,159 | A | 9/1992 | Wolfe et al. |
| 5,227,026 | A | 7/1993 | Hogan |
| 5,296,005 | A | 3/1994 | Wolfe et al. |
| 5,417,492 | A | 5/1995 | Christian et al. |
| 5,697,168 | A | 12/1997 | Matthys et al. |
| 5,944,960 | A | 8/1999 | Nakata et al. |
| 6,675,746 | B2 | 1/2004 | Gerstmann et al. |
| 6,972,085 | B1 | 12/2005 | Brecher et al. |
| 7,594,978 | B2 | 9/2009 | Brecher et al. |
| 2003/0051987 | A1 | 3/2003 | Owen |
| 2008/0053347 | A1 | 3/2008 | Walker et al. |
| 2008/0149471 | A1 | 6/2008 | Wolfe |

FOREIGN PATENT DOCUMENTS

| | | |
|---|---|---|
| CA | 1118207 | 2/1982 |
| DE | 2728661 | 12/1997 |
| GB | 427849 | 5/1935 |
| GB | 539193 | 9/1941 |
| GB | 541314 | 11/1941 |
| GB | 545473 | 5/1942 |
| GB | 793517 | 4/1958 |
| GB | 793518 | 4/1958 |
| GB | 151600 | 6/1978 |
| JP | 53031703 | 3/1978 |
| JP | 2006152193 | 6/2006 |

OTHER PUBLICATIONS

Chu, Charles I.C. et al.; Development of an Advanced, Continuous Mild Gasification Process for the Production of Co-Products; US Dept. of Energy Contract No. DE-AC21-87MC24116; Jan. 1988.

International Search Report and Written Opinion for International Application No. PCT/US2007/088030 mailed May 30, 2008.

International Preliminary Report on Patentability for International Application No. PCT/US2007/088030 mailed Jul. 9, 2009.

McGraw-Hill Book Company, Chemical Engineer's Handbook, Fifth Edition, Solids-Drying Equipment, p. 20-16 to 20-44, (1973).

PYROLYZER FURNACE APPARATUS AND METHOD FOR OPERATION THEREOF

This application is a continuation-in-part of application Ser. No. 11/959,581, filed Dec. 19, 2007, which claims the benefit of U.S. Provisional Patent Application 60/871,863 filed Dec. 26, 2006, incorporated herein by reference in its entirety.

BACKGROUND AND SUMMARY OF THE DISCLOSURE

The present invention relates to processing methods and apparatus for converting coal or other coal-bearing materials into char. Char can be produced by heating coal or other coal-bearing materials to selected temperatures in a reduced-oxygen environment. Char having suitable properties may be used in, among other things, iron and steel processing furnaces.

Heating coal or other coal-bearing materials in a reduced-oxygen environment produces coal gas, volatile liquids and a residue of char. During the process of making char, volatile materials, such as hydrocarbon fuels, in the coal-bearing materials fluidize when heated to a temperature of approximately 650° F. (approximately 350° C.) and higher.

A pyrolyzer furnace is one apparatus that may be used for processing coal and other hydrocarbon materials into char. A pyrolyzer can operate in a batch or in a continuous process. In one continuous pyrolyzer, one or more drive screws rotate within the pyrolyzer furnace, wherein the coal is heated in a reduced-oxygen environment to a temperature to fluidize the volatile material as the coal-bearing materials are moved through the furnace. An example of a continuous pyrolyzer furnace is disclosed in U.S. Pat. No. 5,151,159 to Wolfe, et al. Previous pyrolyzer furnaces disclosed by the prior art had heating elements positioned within the furnace housing, which generated hot spots within the furnace, caused uneven heating of the coal or other coal-bearing material, and caused fatigue and shortened the life of the furnace components.

Another limitation has been the energy efficiency of previous pyrolyzer furnaces. The previous pyrolyzer furnaces were typically heated by electric heaters, or by burning natural gas, fuel oil or propane, to process the fluidized volatile material into hydrocarbon fuel and coal tar products. Pyrolyzer furnaces in the prior art also had drive screws with solid shafts, oil cooled shafts, and other shaft configurations that were thermally inefficient, resulting in the pyrolyzer furnace consuming more fuel.

What has been needed is a pyrolyzer furnace system, and method for making char in that system, that substantially reduces the external energy, e.g. propane, fuel oil, or natural gas, needed for the char making process. The level of additional energy may be reduced to a point that the char making process is sustained by burning only the fluidized volatile materials generated from char making after start up.

Disclosed is a char making apparatus comprising:

a longitudinal pyrolyzer furnace housing wherein coal-bearing material containing volatile materials may be heated to a temperature to fluidize volatile materials therein and plasticize coal in the coal-bearing material;

at least two rotatable drive screws laterally positioned and interleaved within the longitudinal furnace housing and capable of conveying coal-bearing materials containing volatile material through the pyrolyzer furnace housing, each drive screw having a hollow drive shaft and a diverter longitudinally positioned within the drive shaft, the diverter forming with an inner surface of each drive shaft an inner passageway to provide heat flux from the combustion fluid moving through the shaft to adjacent coal-bearing materials moving through the pyrolyzer furnace to enable fluidizing the volatile material therein and plasticizing coal in the coal bearing material;

a heating jacket about the longitudinal furnace housing along at least a portion thereof in fluid communication with combustion fluid from multiple combustion chambers to provide heat flux from the combustion fluid moving through the heating jacket to heat adjacent coal-bearing materials moving through the pyrolyzer furnace to fluidize the volatile material in the coal bearing material and plasticize the coal in the coal bearing material;

multiple combustion chambers adjacent the inner passageways and adjacent the heating jacket capable of burning fluidized combustion material and exhausting combustion fluids through the inner passageway and through the heating jacket to fluidized volatile material in the coal-bearing material and plasticizing coal in the coal-bearing material; and conduit capable of collecting and transferring fluidized volatile material exhausted from the pyrolyzer furnace to the combustion chambers to be burned.

The flow of combustion fluids through the inner passageways within the hollow drive screws may be in the same direction as the drive screws move the coal-bearing materials through the pyrolyzer furnace housing.

Also, the combustion chambers are spaced along the pyrolyzer furnace housing to distribute the combustion fluid moving from such combustion chambers through the heating jacket to exhaust ports from pyrolyzer furnace housing to provide a desired pattern of heat flux from the combustion fluid to the adjacent coal-bearing material moving through the pyrolyzer furnace housing.

Flow controllers may be positioned in the heating jacket and are capable of diverting the flow of combustion fluid through said heating jacket to provide a desired heat flux pattern to fluidize volatile material in the coal bearing material and plasticize coal in the coal bearing material.

Devices may also be positioned in the inner passageways and are capable of causing the flow of heated fluid through the passageway to have a Reynolds Number greater than 4000.

The portion of the pyrolyzer furnace housing downstream through which the coal bearing material moves may have a decreasing cross sectional area in the direction of travel of the coal-bearing material through the pyrolyzer furnace housing to compact the char before exiting the pyrolyzer furnace housing. Or, the pyrolyzer furnace housing may have a tapered outer wall downstream forming a decreasing cross-sectional area of the portion of the pyrolyzer furnace housing through which the coal-bearing material moves in the direction of travel of the coal bearing material through the pyrolyzer furnace housing to compact the char before exiting the pyrolyzer furnace housing.

The hollow drive shaft through each screw may be tapered; decreasing the cross sectional area of the portion of the pyrolyzer furnace housing through which the coal-bearing material moves in the direction of travel of the coal-bearing material through the pyrolyzer furnace housing to compact the char before exiting the pyrolyzer furnace housing.

Alternatively, the pyrolyzer furnace housing may have tapered inner walls and the hollow drive shafts of the drive screws may have tapered outer walls coordinated to decrease the cross sectional area of the portion of the pyrolyzer furnace housing through which the coal-bearing material moves in the direction of travel of the coal-bearing material through the pyrolyzer furnace to compact the char before exiting the pyrolyzer furnace housing.

The heating jacket may surround at least a portion of the pyrolyzer furnace housing, and may surround the pyrolyzer furnace housing substantially along its length.

The char making apparatus may also be capable of fluidizing volatile materials and plasticizing coal in the coal-bearing material to a temperature in a range of 650° F. to 1300° F.

Alternatively the pyrolyzer furnace housing may be inclined at a variable upward angle in the direction of movement of the coal-bearing material through the housing.

At least three drive screws may be laterally positioned within the pyrolyzer furnace housing, the drive screws being positioned such that each drive screw interleaves at least one other drive screw. Further, at least one clearing screw having a smaller diameter may be positioned longitudinally through the furnace housing adjacent the drive screws and may be capable of conveying coal-bearing materials from the drive screws through the pyrolyzer furnace housing.

At least one clearing screw having a smaller diameter may be positioned longitudinally through the furnace housing adjacent the drive screws and capable of conveying coal-bearing materials from the drive screws through the pyrolyzer furnace housing.

Alternatively, the pyrolyzer furnace housing may comprise at least two zones along its length, where the heat flux in the first zone is capable of fluidizing volatile materials, and the second zone is capable of mixing supplemental materials into the coal-bearing materials, and the heat flux in the second and/or subsequent zones is capable of plasticizing coal in the coal-bearing material.

Also, the pyrolyzer furnace housing may comprise at least two zones along its length, where heat flux in the first zone is capable of fluidizing volatile materials, and heat flux in at least one of the subsequent zones are capable of plasticizing coal in the coal-bearing material.

Another char making apparatus is disclosed, comprising:

a longitudinal pyrolyzer furnace housing wherein coal-bearing material containing volatile materials may be heated to a temperature to fluidize volatile materials therein and plasticize coal in the coal bearing material;

at least two rotatable drive screws laterally positioned and interleaved within the longitudinal furnace housing, and capable of conveying coal-bearing materials containing volatile materials through the pyrolyzer furnace housing, each drive screw having a hollow drive shaft and a diverter longitudinally positioned within the drive shaft, the diverter forming with an inner surface of each drive shaft an inner passageway adjacent the coal-bearing materials moving through the pyrolyzer furnace to provide heat flux from the combustion fluid to the coal-bearing material to fluidize the volatile material therein and plasticize coal in the coal bearing material;

double outer walls in the furnace housing at least partially around the rotatable drive screws and forming an outer passageway between the outer walls, the outer passageway capable of moving a combustion fluid adjacent the coal-bearing materials moving through the pyrolyzer furnace housing providing heat flux from the combustion fluid moving through the outer passageways to the coal-bearing material moving through the pyrolyzer furnace housing to fluidize the volatile material in the coal-bearing material and plasticize coal in the coal-bearing material;

multiple combustion chambers adjacent the inner passageway and adjacent the outer passageway capable of burning fluidized combustion material and moving combustion fluids through the inner passageway and the outer passageway to fluidized volatile material in the coal-bearing material and plasticizing coal in the coal-bearing material; and conduit capable of collecting and transferring fluidized volatile material exhausted from the pyrolyzer furnace to the combustion chambers to be burned.

Also disclosed is a method for making briquettes comprising the steps of assembling a longitudinal pyrolyzer furnace housing having at least two rotatable drive screws laterally positioned and interleaved within a longitudinal furnace housing and a heating jacket about the longitudinal furnace housing to provide heat flux from combustion fluid moving through the heating jacket to adjacent coal-bearing materials; moving coal-bearing materials through the pyrolyzer furnace by rotation of the drive screws and heating to fluidize volatile material in the coal bearing material and plasticize the coal in the coal bearing material to form processed char; mixing the processed char with a binding agent and a binder coal of a fluidity at least 2,000 ddpm to form a blend of less than 15% binding agent, 25 to 70% processed char and 20 to 70% binder coal; and briquetting the blend to form a briquetted blend that can be carbonized to form metallurgical coke.

Also disclosed is a system for making briquettes comprising a longitudinal pyrolyzer furnace housing having at least two rotatable drive screws laterally positioned and interleaved within the longitudinal furnace housing, and capable of conveying coal-bearing materials containing volatile material through the pyrolyzer furnace housing and a heating jacket about the longitudinal furnace housing along at least a portion thereof in fluid communication with combustion fluid from multiple combustion chambers to provide heat flux from combustion fluid moving through the heating jacket to adjacent coal-bearing materials moving through the pyrolyzer furnace to fluidize the volatile material in the coal bearing material and plasticize the coal in the coal bearing material to produce processed char; a mixer for combining a binder coal having a fluidity of at least 2,000 ddpm, a binder and said processed char in a preferred ratio to form a blend having: less than 15% binding agent, 25 to 70% processed char, and 20 to 70% binder coal; and a briquetter for forming the blend to form a briquette which when carbonized forms a metallurgical coke.

DETAILED DESCRIPTION OF THE DISCLOSURE

As used herein, the term "coal" refers to mined carbonaceous material containing organic compounds and volatile materials that may be converted to a plastic phase at elevated temperatures where carbonaceous material is separated from the volatile materials. One example of this type of coal is bituminous coal.

As further used herein, the term "fluidize" means release of volatile material from coal with heating during a process where gases and entrained particulate matter, which may or may not be combined with other gases, are released.

Figure 1:
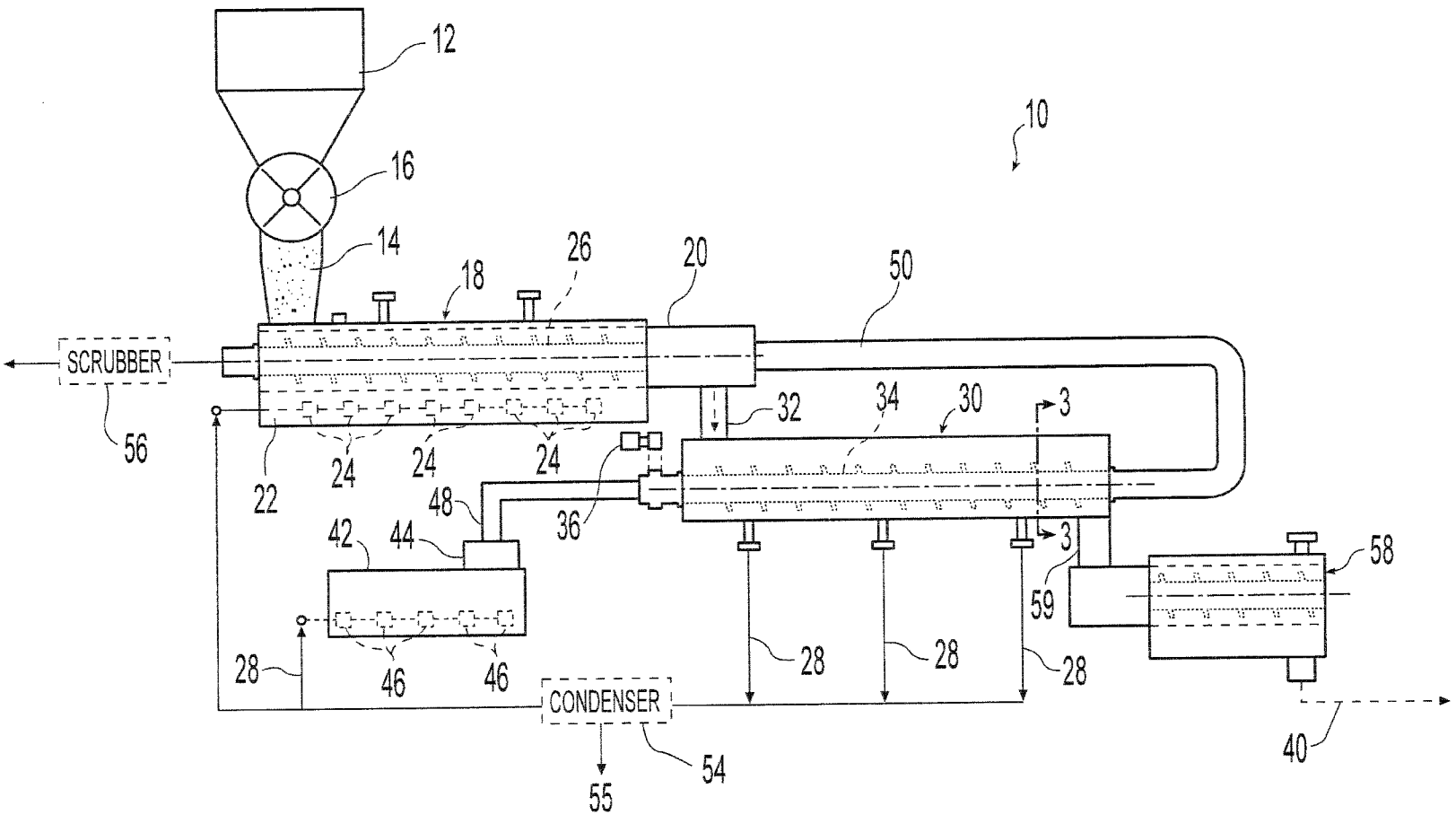
FIG. 1 is a system for making char.

Referring now to FIG. 1, a furnace apparatus 10 is provided for making char. The furnace apparatus 10 receives, as raw materials, coal-bearing material having a predetermined size and processes the coal-bearing material into an atmosphere containing little, if any, oxygen. In the furnace, the coal-bearing material is dried and then heated to a temperature to fluidize the volatile materials in the coal and coal-bearing material and plasticize coal in the coal-bearing material.

The furnace apparatus 10 comprises a receiving hopper 12 for containing coal-bearing materials 14 containing coal particles of a predetermined size. The size of the coal particles 14 may be, for example, in a range of about ¼ inch to about −6 Tyler mesh (about 6.4 mm to about 3.3 mm). The coal-bearing material 14 pass from the receiving hopper 12 through an airlock 16 and into a pre-dryer 18. The coal-bearing material 14 may less than 20 mesh or so prevalent as effluent from coal washing facilities and in reclaiming coal from settlement ponds created from past coal washing facility operations. These small coal particles are readily available in this coal-bearing material, but generally are not used because they are difficult to transport and use.

The pre-dryer 18 comprises a drying chamber 20 within a drying furnace 22 having a plurality of burners 24 mounted therein. The drying chamber 20 has a drive screw 26 rotatably mounted therein for conveying the coal particles 14 or other coal-bearing material, through the drying chamber 20. The temperature in the drying chamber 20 may be maintained at about 400° F. (approximately 200° C.) to release at least a portion of the water vapor incorporated within the coal-bearing material 14. A portion of the volatile materials 28 in some coal and coal-bearing material may begin to volatilize in the pre-dryer at about 400° F. (approximately 200° C.). The pre-dryer 18 may be maintained at a temperature of about 300° F. (approximately 150° C.) or lower to remove water vapor while fluidizing little or no volatile materials 28.

The pyrolyzer furnace 30, or retort furnace, may be hermetically connected to the pre-dryer 18 and receive the processed coal-bearing material 14 from the pre-dryer by way of an airlock and screw feeder 32. Two drive screws 34 are laterally positioned adjacent each other in an overlapping array within a longitudinal furnace housing 31 of pyrolyzer furnace 30. Each drive screw 34 is rotatably mounted interleaved within the pyrolyzer furnace housing 31 to move the coal-bearing material therethrough. An electric or pneumatic motor 36 may be provided to drive the drive screws 34 through a drive train (not shown).

In one embodiment, the coal-bearing materials passing through the pyrolyzer furnace 30 are heated by hot combustion fluids. In the embodiment of FIG. 1, a combustion chamber 42 comprises a blower 44 and a plurality of burners 46 designed to combust fluidized volatile materials or other fuel at temperatures at which volatile material in coal-bearing material will fluidize and coal in the coal bearing material will plasticize. A conduit 48 transfers combusted fluids from the combustion chamber 42 to the pyrolyzer furnace 30. The combustion chamber 42 is capable of burning fluidized volatile materials 28 and/or other hydrocarbon fuels (e.g. propane, natural gas, or fuel oil), and transferring the combustion fluids to the pyrolyzer furnace 30 by the blower 44 through the conduit 48.

As shown in FIG. 1, the hot combustion fluids flow through the pyrolyzer furnace 30 and then into a dryer conduit 50. The hot combustion fluids from the combustion chamber may enter the pyrolyzer furnace 30 through conduit 48 at a temperature of about 1600 to 1700° F. (about 870 to 930° C.), and may leave the pyrolyzer furnace 30 through dryer conduit 50 at a temperature of about 400 to 500° F. (about 200 to 260° C.). The combustion fluids move through the dryer conduit 50 to the pre-dryer 18. The combustion fluids may pass through the pre-dryer 18 to dry and preheat the coal-bearing material, and may be exhausted at a temperature of about 100° F. (about 38° C.). If desired, a scrubber 56 may receive the exhausted fluids from the pre-dryer 18 to further separate sulfur and other impurities before being emitted to the ambient environment.

The pyrolyzer furnace 30 is heated to a temperature to fluidize and release the volatile materials 28 and water vapor contained within the coal of the coal-bearing material 14, including hydrocarbon fuels. The fluidized volatile materials 28 may comprise hydrogen and methane. Suitable piping or other conduit are provided to transfer the fluidized volatile materials 28 from the pyrolyzer furnace 30 to the combustion chamber 42, and the pre-dryer 18, if desired, to fuel burners 46 in the combustion chamber 42 and the burners 24 in pre-dryer 18.

As shown in FIG. 1, a condenser 54 may be optionally provided in communication with the pyrolyzer furnace 30 to separate liquids from the fluidized volatile materials 28. If desired, the condenser 54 may be used to separate coal tar liquids 55 and water from gaseous coal fluids using known methods and apparatus. Coal tar liquids may be collected for sale as a commodity, or may be transferred to the combustion chambers 24 in the pre-dryer 18 and the burners 46 in the combustion chamber 42 to be burned as fuel. However, in view of environmental and efficiency concerns, the char making apparatus 10 is best operated with internal recovery where the fluidized volatile material is transferred to the combustion chamber 42, or the pre-dryer 18, to be combusted to provide combustion fluids for transfer to the pyrolyzer 30.

The longitudinal furnace housing 31 of the pyrolyzer furnace 30 houses a portion where coal in coal-bearing material 14 containing volatile materials may be heated to a temperature to fluidize volatile materials therein and plasticize coal in the coal-bearing material. The drive screws 34 are rotatably positioned within and along the length of the longitudinal furnace housing 31. The drive screws 34 are rotated to move coal-bearing material through the furnace housing 31 and discharge devolatilized and plasticized coal residue, char 40, from the pyrolyzer furnace 30. Char 40 from the pyrolyzer furnace 30 may be transferred to a char cooler 58, which may be hermetically connected to the pyrolyzer furnace 30 by way of an airlock and screw feeder 59. In one embodiment, the char cooler 58 cools the char 40 to a temperature below that which the char would ignite if exposed to ambient air.

Figure 2:
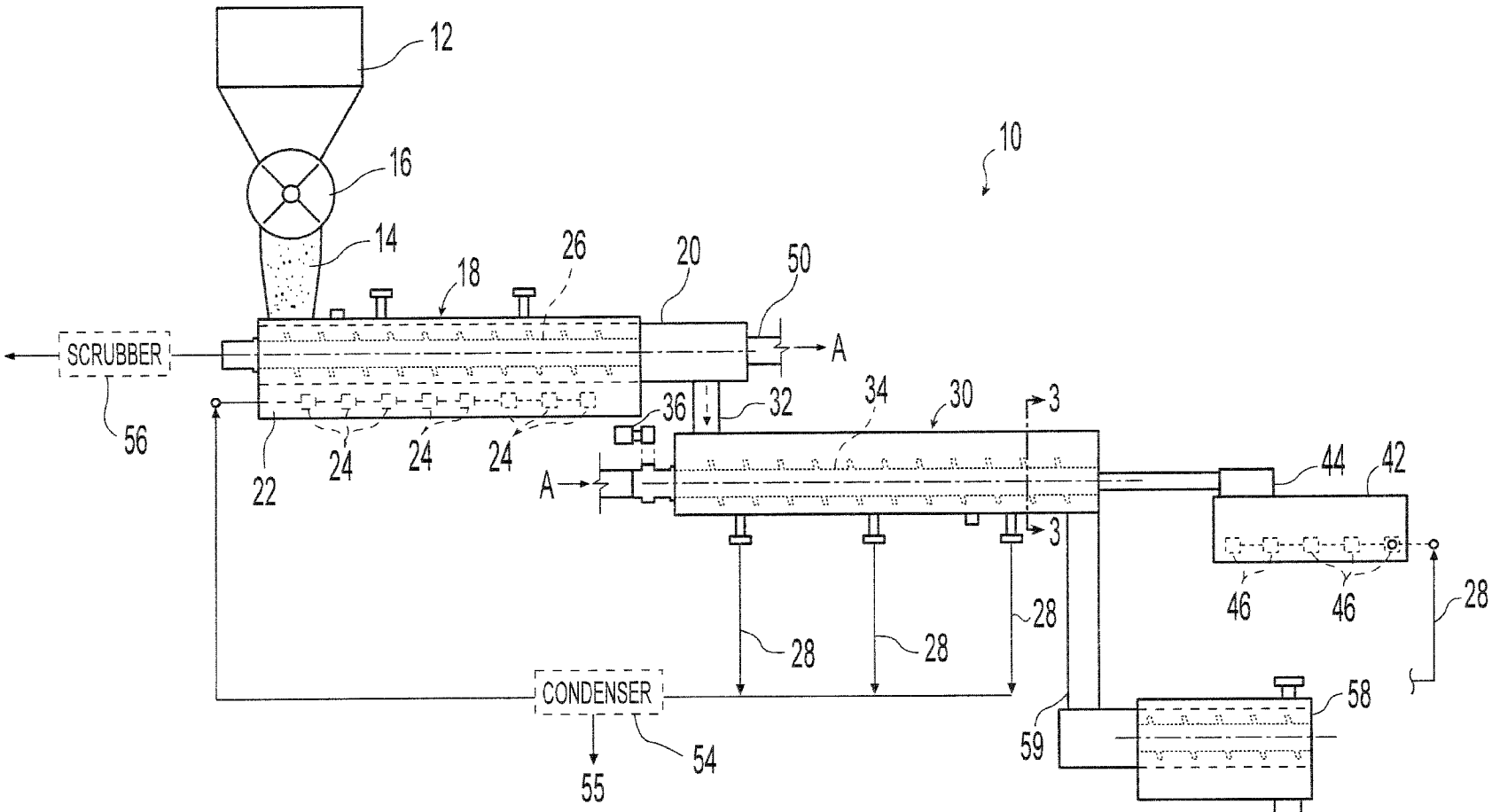
FIG. 2 is a second embodiment of a system for making char.

In the embodiment of FIG. 1, the exhausting combustion fluids flow through the inner passageways 68 (FIG. 3) of drive shafts 34 in the direction of the coal or coal-bearing material moving through the pyrolyzer furnace housing 31. In the embodiment of FIG. 2, the exhausting combustion fluids flow through the inner passageways 68 of the drive shafts 34 opposite, counter-current the direction of the coal-bearing material moving through the pyrolyzer furnace 30.

Figure 3:
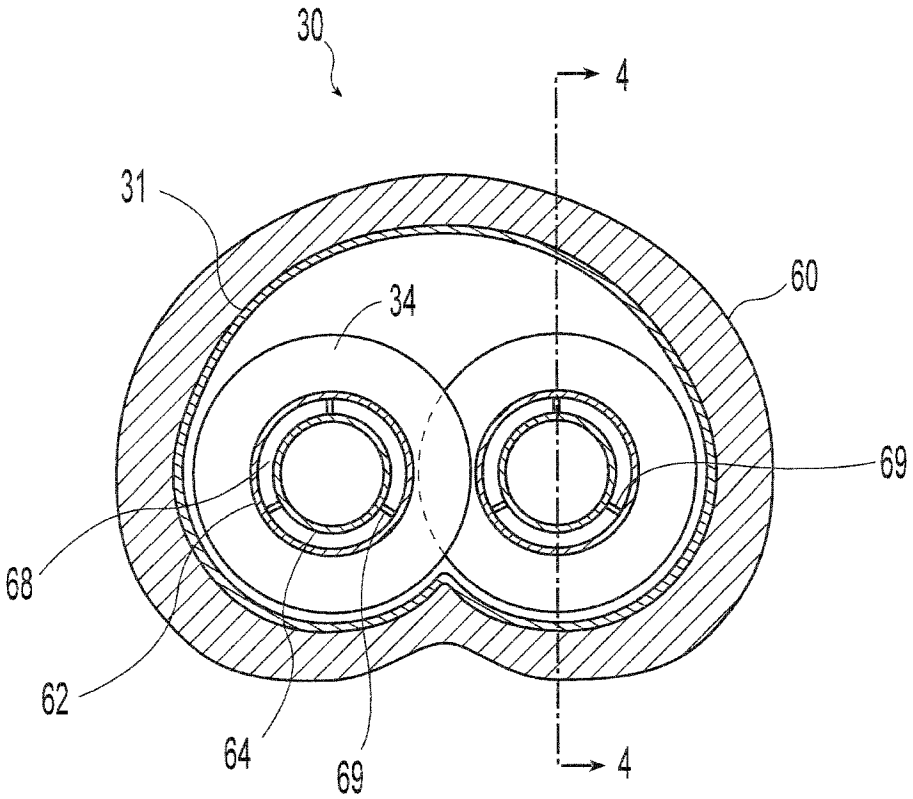
FIG. 3 is a cross sectional view through a pyrolyzer of the present disclosure through the section marked 3-3 in FIG. 1 or FIG. 2.
Figure 4:
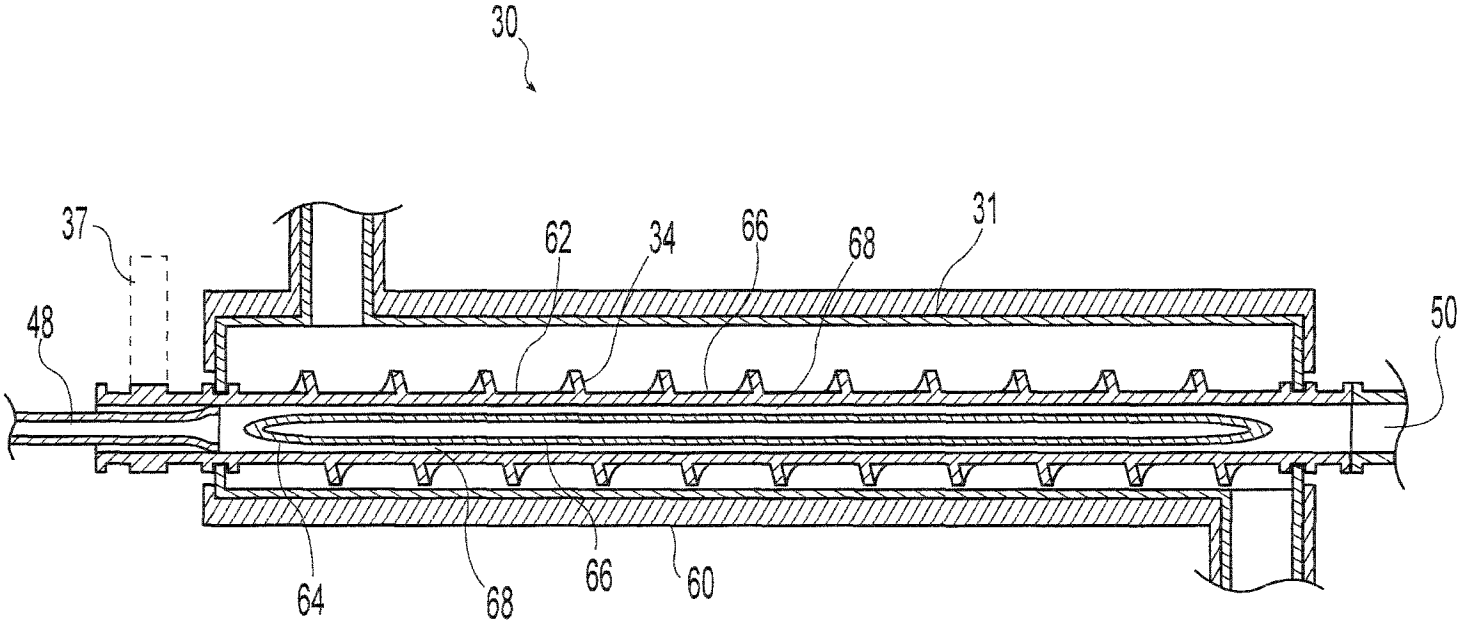
FIG. 4 is a cross sectional view through the pyrolyzer of FIG. 3 through the section marked 4-4 in FIG. 3.

More details of the pyrolyzer furnace 30 of the first and second embodiments of FIGS. 1 and 2 is shown in FIGS. 3 and 4 and taken along line 3-3 in FIGS. 1 and 2. The pyrolyzer furnace of FIG. 3 comprises the longitudinal furnace housing 31 at least partially covered by an insulating layer 60. At least two drive screws 34 are laterally positioned, adjacent and overlapping, capable of moving coal-bearing material 14 containing volatile materials 28 through the pyrolyzer furnace 30. The two drive screws 34 are rotatably mounted in the pyrolyzer furnace housing 31 and are driven by a conventional drive (not shown).

The pyrolyzer furnace housing 31 may be shaped to provide a volume above the drive screws 34, as illustrated in FIG. 3. The volume above the screws 34 provides a space for coal particles in the coal-bearing material 14 to expand above the drive screws 34 as the coal increases in temperature as it is moved through the pyrolyzer furnace 30. It is contemplated that some embodiments may provide more or less volume above the screws 34 depending on the thermal expansion or swelling properties of the particular coal in the coal-bearing material 14 that is processed through the pyrolyzer furnace 30. Typically the coal in the coal-bearing material is a bituminous coal.

As shown in FIGS. 1 and 2, each drive screw 34 comprises a hollow drive shaft 62 (FIG. 3) in communication with the combustion chamber 42. The conduit 48 may connect the combustion chamber 42 with the drive shafts 62. The combustion chamber 42 is capable of burning fluidized volatile materials 28 and, if desired, other hydrocarbon fuels, and conveying heated combustion fluids from the combustion chamber 42 through the conduit 48 into the hollow drive shafts and directed and restricted by inner passageways 68 within the hollow drive shafts 62.

As shown in FIGS. 3 and 4, a diverter 64 is longitudinally positioned within the hollow drive shafts 62. Each diverter 64 comprises an outer surface 66 forming with an inner surface of the drive shaft 62 an inner passageway 68 capable of directing heat flux from heated combustion fluid to adjacent the coal-bearing materials moving through the pyrolyzer furnace 30, to fluidize the volatile material therein and plasticizing coal in the coal-bearing material. In one embodiment, blower 44 moves the exhausted combustion fluids from the combustion chamber 42 through the conduit 48 and into the inner passageways 68 of drive shafts 62 for heating the coal-bearing material moving through the pyrolyzer furnace 30.

As illustrated in FIG. 3, diverter 64 may be centered within each hollow drive shaft 62 by a plurality of ribs 69 extending radially from the outer surface 66. The ribs 69 may extend along the lengths of the diverter 64. Alternately, a plurality of small ribs 69 may hold the diverter in place. In one embodiment, the ribs 69 have an airfoil shape. In another embodiment, the ribs 69 are shaped and positioned to disrupt the flow of fluid through the inner passageway 68 for creating turbulent flow. The ends of the diverter 64 may be tapered as illustrated in FIG. 4. Alternately, the ends of the diverter 64 may be flat, spherical, or any other shape suitable for directing flow of combustion fluid into and through the inner passageways 68.

In one embodiment, the outer surface 66 of the diverter 64 comprises an approximately cylindrical shape. It is contemplated that the outer surface 66 may comprise a corrugated shape or other shape for forming inner passageways 68 having various shapes and desired fluid flow through inner passageways 68. In one embodiment, the outer surface 66 comprises a surface corrugated to direct flow in a spiral around the diverter 64. The outer surface 66 of the diverter 64 may comprise fluid agitators or other devices for causing a turbulent flow in the inner passageway 68. It is contemplated that the agitators or other devices may be protrusions, tabs, ribs, or other shapes suitable for causing turbulent flow in the inner passageway 68. It is contemplated that the location, size, and shape of the inner passageways 68 may be varied to generate a turbulent flow having a Reynolds Number greater than 4000. In any case, the heat flux is efficiently transferred from the combustion fluid to the coal-bearing material moving through the pyrolyzer 30.

In one embodiment, the pyrolyzer furnace 30 heats the coal-bearing material 14 to a temperature within a range of approximately 650° F. to 1300° F. (approximately 340° C. to 700° C.) to fluidize volatile materials 28 within the coal-bearing material 14 and plasticize coal in the coal-bearing material 14. In an alternate embodiment, the pyrolyzer furnace 30 heats the coal-bearing material 14 containing volatile materials 28 to a temperature to about 1700° F. (about 930° C.) or higher. As different volatile materials fluidize and different coals plasticize at different temperatures, it is contemplated that the pyrolyzer furnace 30 may heat the coal-bearing material to a selected temperature for fluidizing the volatile materials within the coal-bearing material and another selected temperature to plasticize coal in the coal-bearing material.

The insulating layer 60 may be a ceramic or other high temperature insulative material. It is contemplated that the insulating layer 60 may be a fabricated structure, a wrapped insulation blanket, a sprayed-on insulative material, or any other insulative or composite material around the pyrolyzer furnace 30.

In the embodiment of FIGS. 1 and 2, the drive screw 26 of pre-dryer 18 comprises a hollow drive shaft 27 in communication with the dryer conduit 50. In one embodiment, the pre-dryer drive shaft 27 further comprises a diverter to form an inner passageway between the diverter and an inner surface of the drive shaft 27, capable of diverting heated fluid adjacent the coal-bearing material moving through the pre-dryer 18. Alternately, the drive shaft 27 may be capable of receiving oil, and the dryer conduit 50 is in communication with an oil heater for heating the oil flowing through the drive shaft 27. In one embodiment, the drive shaft 27 is a Holo-Flite® screw capable of receiving oil heated by the hot combustion fluids from the dryer conduit 50.

Figure 5:
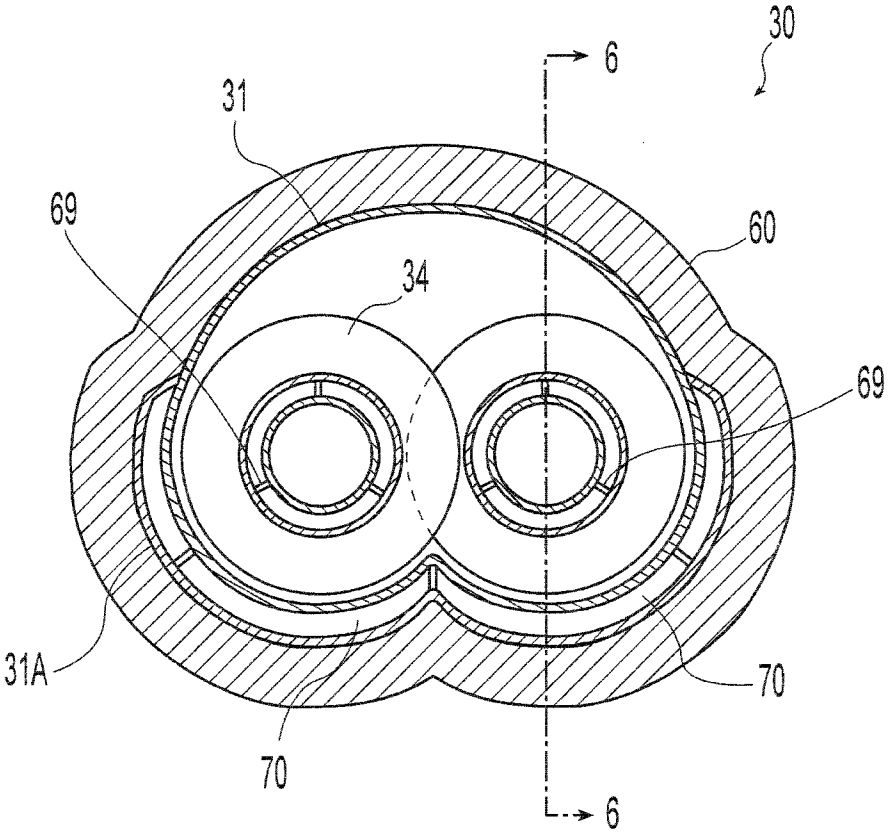
FIG. 5 is a cross sectional view through an alternate embodiment including a double wall pyrolyzer of the present disclosure through the section marked 3-3 in FIG. 1 or FIG. 2.
Figure 6:
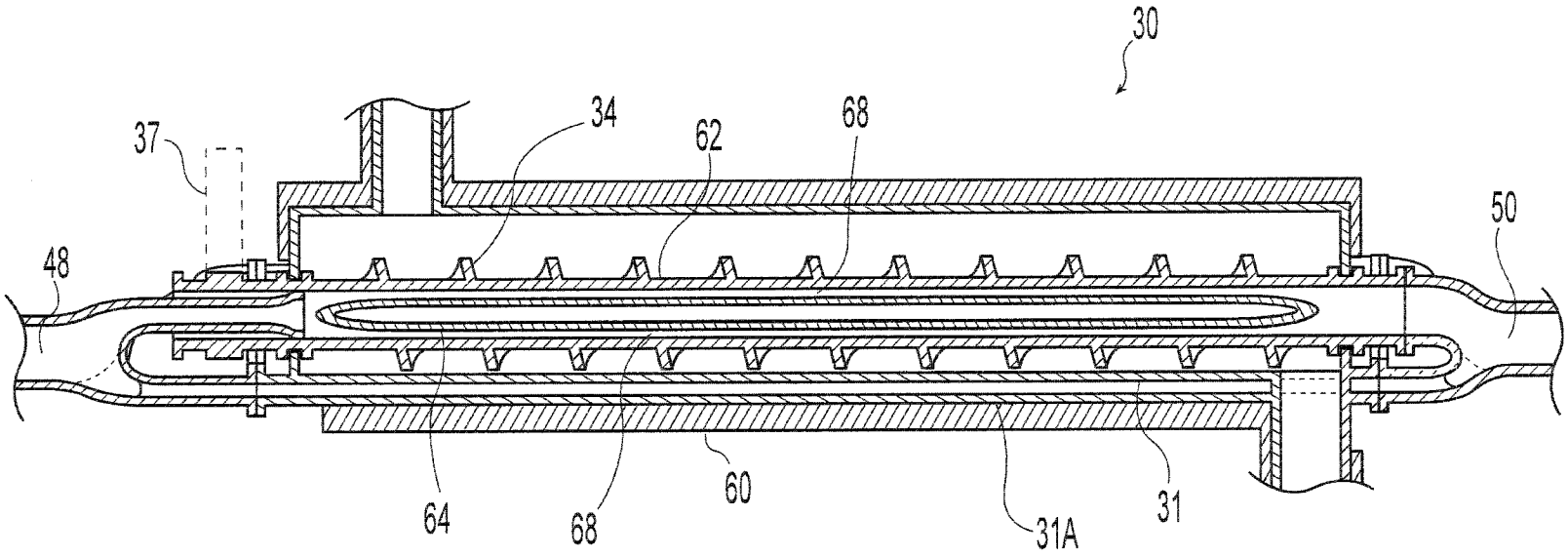
FIG. 6 is a cross sectional view through the pyrolyzer of FIG. 5 through the section marked 6-6 in FIG. 5.

In an alternate pyrolyzer embodiment shown in FIGS. 5 and 6, the pyrolyzer furnace 30 comprises double outer walls 31A forming an outer passageway 70 or heating jacket in the pyrolyzer furnace housing 31 at least partially around the drive screws 34. The outer passageway 70 formed between the outer walls 31, 31A is capable of conveying a flow of heated combustion fluid adjacent to the coal-bearing material moving through the pyrolyzer furnace to fluidize the volatile material therein and plasticize coal in the coal-bearing material. The heating jacket of the pyrolyzer furnace 30 in this embodiment is at least partially covered by the insulating layer 60. In the embodiment of FIGS. 5 and 6, the pyrolyzer furnace housing 31 comprises the partial double outer wall 31A, such that the outer passageway 70 surrounds a portion of the pyrolyzer furnace. Alternately, as in the embodiment of FIGS. 7 and 8, the double outer wall 31A forming the heating jacket of the pyrolyzer furnace housing 31, such that the outer passageway 70 surrounds the pyrolyzer furnace 30.

In this embodiment, a conduit, such as the conduit 48, connects the outer passageway 70 to the combustion chamber 42 for conveying exhausted combustion fluids from the combustion chamber 42 into the outer passageway 70 heating jacket of the pyrolyzer furnace 30. The combustion chamber 42 is capable of combusting fluidized volatile materials 28 and/or other hydrocarbon fuels, and exhausting combustion fluids through the outer passageway 70 for heating the coal-bearing material and plasticizing coal in the coal-bearing material within the pyrolyzer furnace.

In the embodiments of FIGS. 5 to 8, the blower 44 may move the exhausted combustion fluids from the combustion chamber 42 through the conduit 48, and into the inner passageways 68 of the drive shafts 62 and the outer passageway 70, thereby heating the coal-bearing material moving through the pyrolyzer furnace 30. It is contemplated that the location, size, and shape of the inner passageways 68 and the outer passageway 70, and the ribs within, may be varied to cause the flow of heated fluid through said passageways to have a turbulent flow having a Reynolds Number greater than 4000.

The outer passageway 70 may have fluid agitators or other devices positioned between the double walls of the heating jacket to cause a turbulent flow of heated combustion fluid therein. It is contemplated that the agitators or other devices may be protrusions, tabs, ribs, or other shapes suitable for causing turbulent flow in the outer passageway 70. It is further contemplated that the location, size, and shape of the outer passageway 70 may be varied to cause the flow of heated fluid through said passageway to have a turbulent flow having a Reynolds Number greater than 4000 to improve the heat flux efficiency from combustion fluids to the coal-bearing material to fluidize volatile materials from the coal-bearing material and plasticize the coal in the coal-bearing material.

Figure 7:
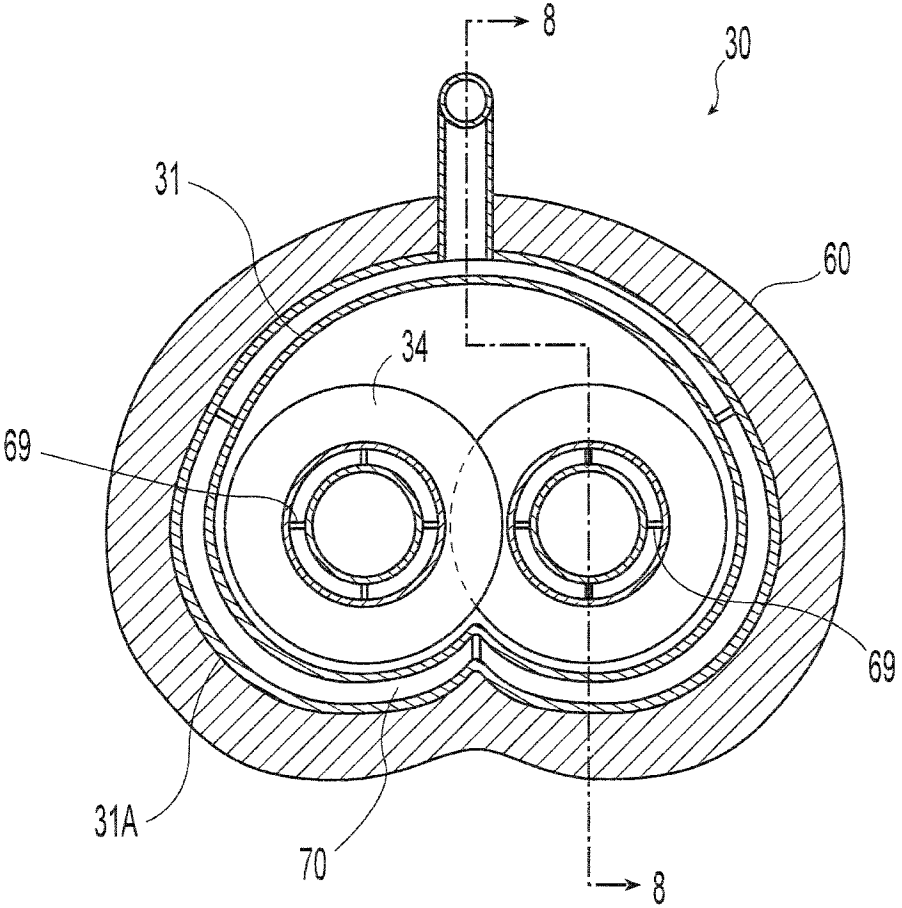
FIG. 7 is a cross sectional view through a third embodiment of a double wall pyrolyzer of the present disclosure through the section marked 3-3 in FIG. 1 or FIG. 2.
Figure 8:
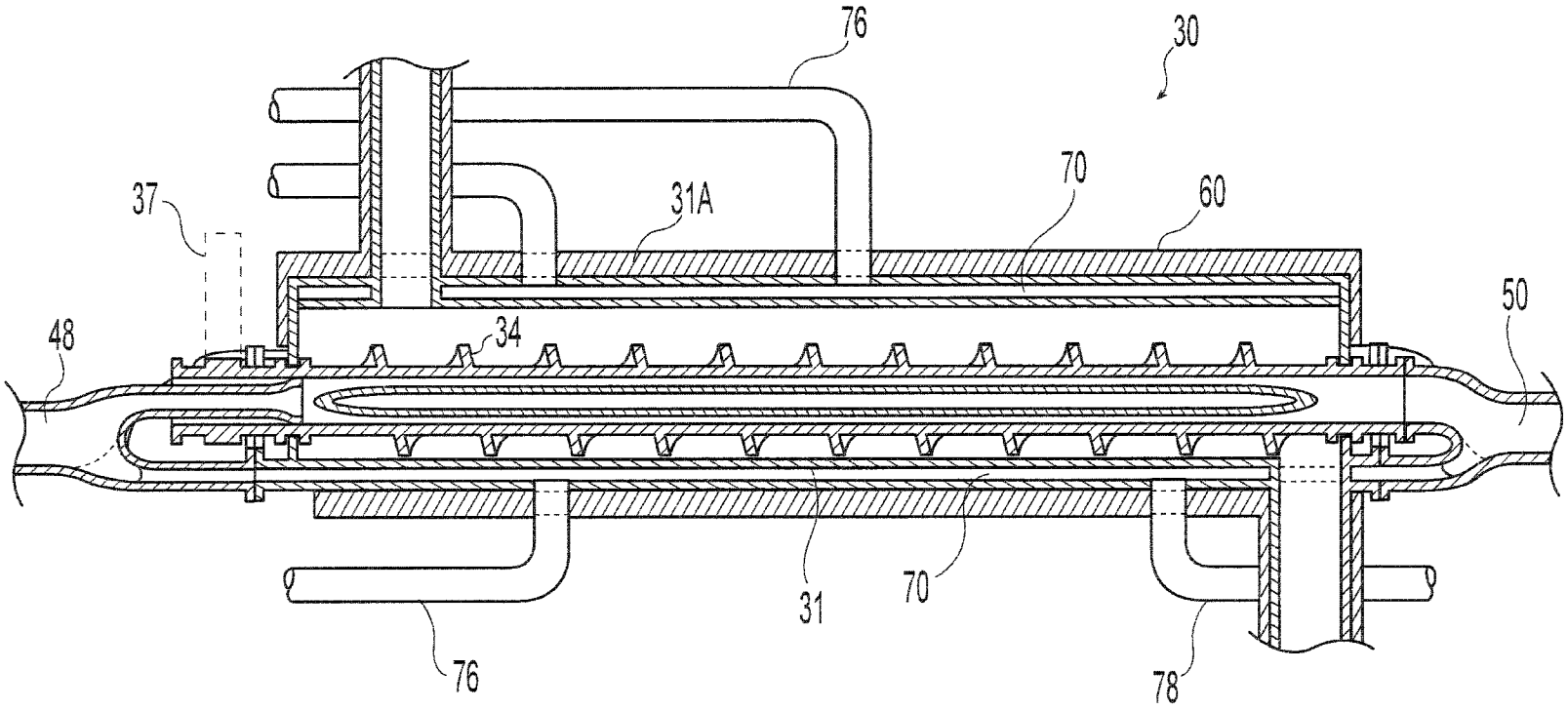
FIG. 8 is a cross sectional view through the pyrolyzer of FIG. 7 through the section marked 8-8 in FIG. 7.

As shown in FIGS. 7 and 8, optionally, one or more manifold conduits 76 may be provided for conveying heated combustion fluid to a selected portion of the outer passageway 70 along the pyrolyzer furnace housing 31. The manifold conduits 76 may be in communication with the combustion chamber 42, and capable of transferring heated combustion fluid to selected portions of the outer passageway 70 longitudinally along the pyrolyzer furnace housing 31. The manifold conduits 76 may be provided to maintain a selected temperature distribution along the pyrolyzer furnace 30 to fluidize volatile material in the coal-bearing material and plasticize coal in the coal-bearing material. In this embodiment, the combustion chamber 42 may transfer through conduit 48 combustion fluids to the inner passageways 68 and the outer passageway 70 which may then exit through the manifold conduits 76. At least one exit conduit 78 may be provided for transferring combustion fluid out of the outer passageway 70. The heated combustion fluids may enter the outer passageway 70 through an entry end of the pyrolyzing furnace housing 31, one or more manifold conduits 76, and other any suitable location.

Figure 9:
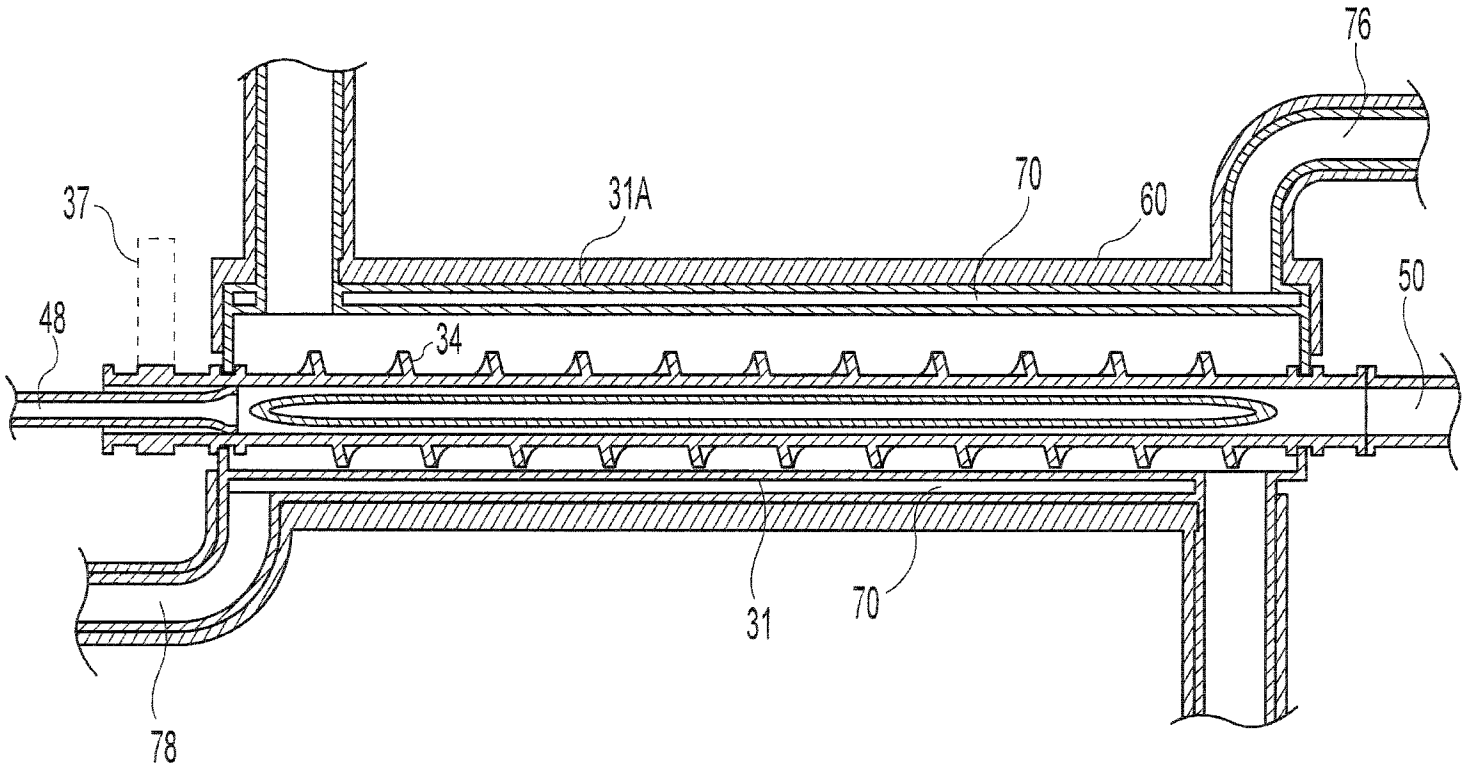
FIG. 9 is a cross sectional view through a fourth embodiment of a pyrolyzer furnace of the present disclosure.

As shown in FIG. 9, the flow of heated combustion fluid in the inner passageways 68 and outer passageway 70 may be opposite the direction of movement of coal-bearing material through the pyrolyzer furnace 30. In this embodiment, heated combustion fluid enters the outer passageway 70 by way of one or more manifold conduits 76, and transfers out of the outer passageway 70 by way of one or more exit conduits 78.

Figure 10:
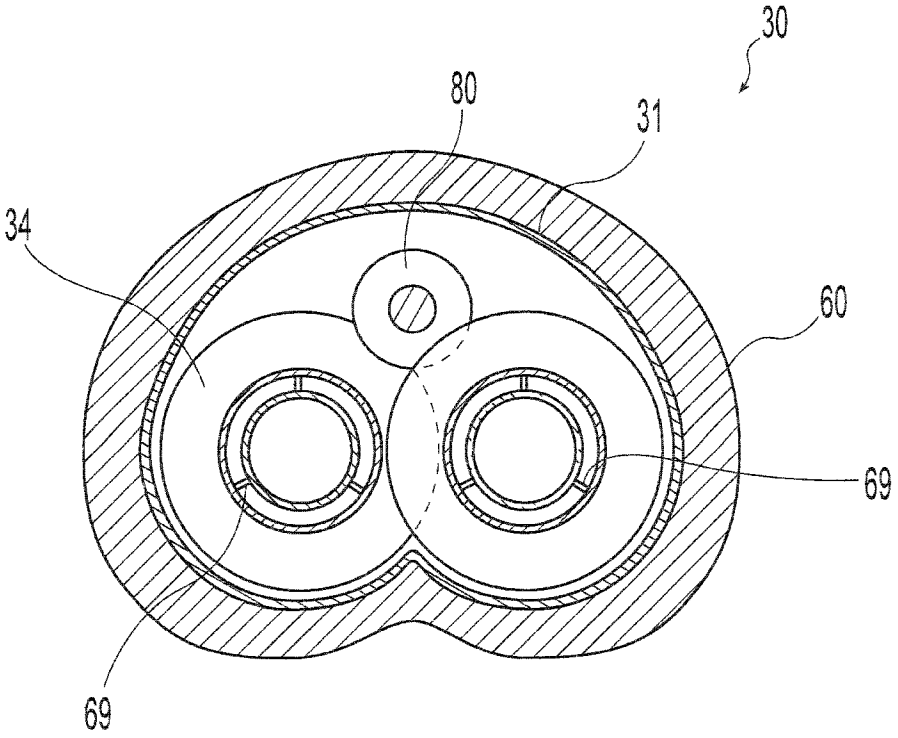
FIG. 10 is a cross sectional view through a fifth embodiment of a pyrolyzing furnace with three screws through the section marked 3-3 in FIG. 1 or FIG. 2.

In one embodiment shown in FIG. 10, the pyrolyzer furnace 30 comprises at least three screws laterally positioned adjacent and overlapping, the drive screws 34 being positioned such that each screw overlaps at least one other drive screw. In the embodiment of FIG. 10, two larger drive screws 34 are provided, and one small screw 80 is provided having a smaller diameter than adjacent drive screws 34 and positioned longitudinally through the furnace housing adjacent the drive screws. The small screw 80 may be capable of conveying additional fine coal to the mix with the coal-bearing material or clearing coal-bearing material from the drive screws 34 through the pyrolyzer furnace housing. It is contemplated that alternate embodiments may comprise at least three drive screws 34 and two clearing screws 80 for either purpose. Alternately, four large drive screws 34 and three small clearing screws 80 may be provided. It is contemplated that any number of screws may be provided to accommodate a desired capacity of coal-bearing material to be processed. The small clearing screws 80 may flow counter-current to the large screws 34.

In one embodiment, clearing screw 80 may comprise a hollow drive shaft and a diverter, forming an inner passageway being in communication with heated combustion fluids from the combustion chamber 42, as disclosed above with reference to the larger drive screws 34.

Figure 11:
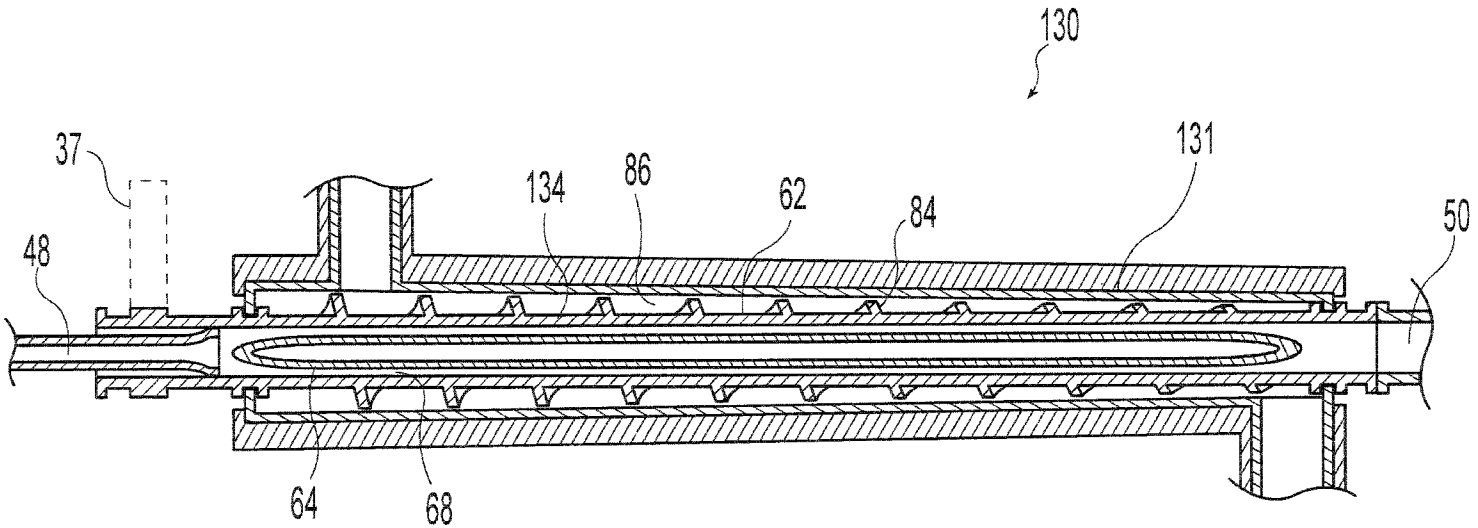
FIG. 11 is a longitudinal cross sectional view through a sixth embodiment of a compacting pyrolyzer of the present disclosure.

As shown in FIG. 11, the portion of the pyrolyzer furnace housing through which the coal-bearing material moves may have a decreasing cross sectional area in the direction of travel of the coal-bearing material through the pyrolyzer furnace housing. FIG. 11 illustrates pyrolyzer furnace 130 having a tapered pyrolyzer furnace housing 131 with a tapered outer wall forming a decreasing cross-sectional area of the portion of the pyrolyzer furnace housing through which the coal-bearing material moves in the direction of travel of the coal-bearing material. In this embodiment, the tapered pyrolyzer furnace housing 131 comprises at least two rotatably mounted tapered drive screws 134, laterally positioned adjacent and overlapping, and being capable of conveying coal-bearing material containing volatile materials 28 through the pyrolyzer furnace 130.

As shown in FIG. 11, the tapered drive screws 134 comprise a screw flight 84 having a decreasing diameter corresponding to the reducing cross section of the pyrolyzer furnace 130, and hollow drive shafts 62 in communication with the combustion chamber 42. Thus, in this embodiment, the portion 86 located between the drive shaft 62 and the pyrolyzer furnace housing 131, through which the coal-bearing material moves, decreases in cross sectional area along the length of the pyrolyzer furnace.

As coal-bearing material containing volatile materials is conveyed through the pyrolyzer of the embodiment of FIG. 11, the coal-bearing material is plasticized and forced into the reducing area 86 by the screw flight 84, thereby compacting the coal-bearing material as it is conveyed through the pyrolyzer furnace and becomes char. This compaction of the plasticized coal is accentuated if the coal in the coal-bearing material swells as some forms of coal do during plasticization.

In this embodiment, the diverters 64 are positioned within the hollow drive shafts 62. The diverter 64 comprises the outer surface 66 forming with the inner surface of the drive shaft 62 an inner passageway 68 capable of diverting heated combustion fluid adjacent the coal-bearing material and provides high heat flux to coal-bearing materials moving through the pyrolyzer furnace 130 to fluidize the volatile material therein and plasticize coal in the coal-bearing material. In one embodiment, the blower 44 moves the exhausted combustion fluids from the combustion chamber 42 through the conduit 48 and into the inner passageway 68 for directing heat flux to the coal-bearing material moving through the pyrolyzer furnace 130.

Figure 12:
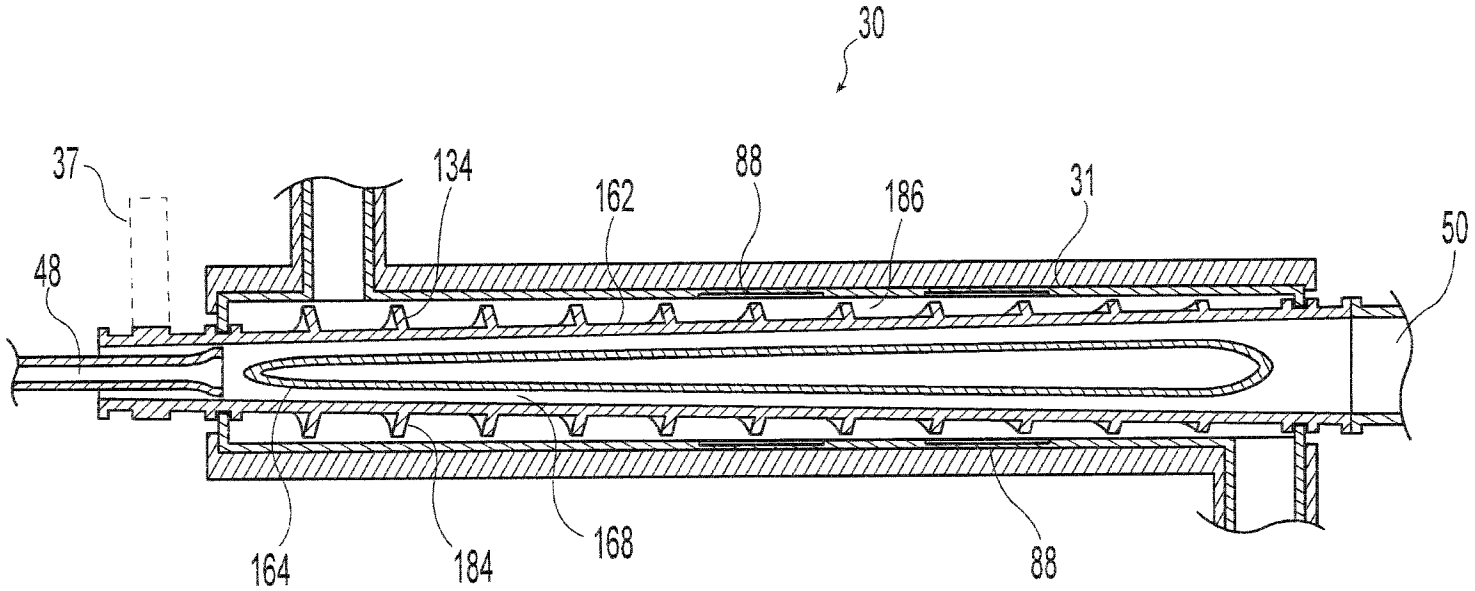
FIG. 12 is a longitudinal cross sectional view through a seventh embodiment of a compacting pyrolyzer of the present disclosure.

In an alternate compacting embodiment shown in FIG. 12, the pyrolyzer furnace 30 comprises at least two rotatable tapered drive screws 134, laterally positioned adjacent and overlapping, capable of conveying coal-bearing material containing volatile materials and plasticizing coal in the coal-bearing material through the pyrolyzer furnace 30.

In this embodiment, each tapered drive screw 134 comprises a hollow tapered drive shaft 162 in communication with and heated by the combustion chamber 42, and a screw flight 184 having a given outside diameter adjacent to an inner wall of the pyrolyzer furnace housing 31. In this embodiment, the hollow drive shafts 162 through each drive screw has a tapered outer wall with an increasing diameter along the length of the screw in the direction of travel of the coal-bearing material. The tapered outer wall of the drive shaft 162 is capable of reducing the cross-sectional area of the portion 186 of the pyrolyzer furnace housing 31 through which the coal-bearing material moves, located between the hollow drive shaft 162 and the pyrolyzer furnace housing 31, in the direction of travel of the coal-bearing material through the pyrolyzer furnace housing. Optionally, the pyrolyzer furnace 30 may comprise one or more slots 88 to provide an area for the coal-bearing material to expand.

As the coal-bearing material containing volatile materials convey through the pyrolyzer of the embodiment of FIG. 12, the coal-bearing material is forced in portion 186 through a reduced cross-section by the screw flight 184, thereby compacting and plasticizing the coal or coal-bearing material as it is conveyed through the pyrolyzer furnace 30.

In this embodiment, a tapered diverter 164 is positioned within the hollow drive shafts 162. The tapered diverter 164 comprises a reverse taper cooperating with the taper of the drive shaft 162 to form one or more inner passageways 168 through the drive shaft 162, capable of diverting heated combustion fluid adjacent the coal-bearing material moving through the pyrolyzer furnace 30 to fluidize the volatile material therein and plasticize coal in the coal-bearing material. The blower 44 moves the exhausted combustion fluids from the combustion chamber 42 through the conduit 48 and into the inner passageway 168 for directing heat flux to the coal-bearing material moving through the pyrolyzer furnace 30.

In the embodiment of FIG. 12, optionally, the pyrolyzer furnace housing 131 may have tapered inner walls (not shown). The tapered inner walls may be coordinated with the tapered outer walls of the hollow drive shafts 162 to decrease the cross sectional area of the portion of the pyrolyzer furnace housing through which the coal-bearing material moves in the direction of travel of the coal-bearing material through the pyrolyzer furnace.

Figure 13:
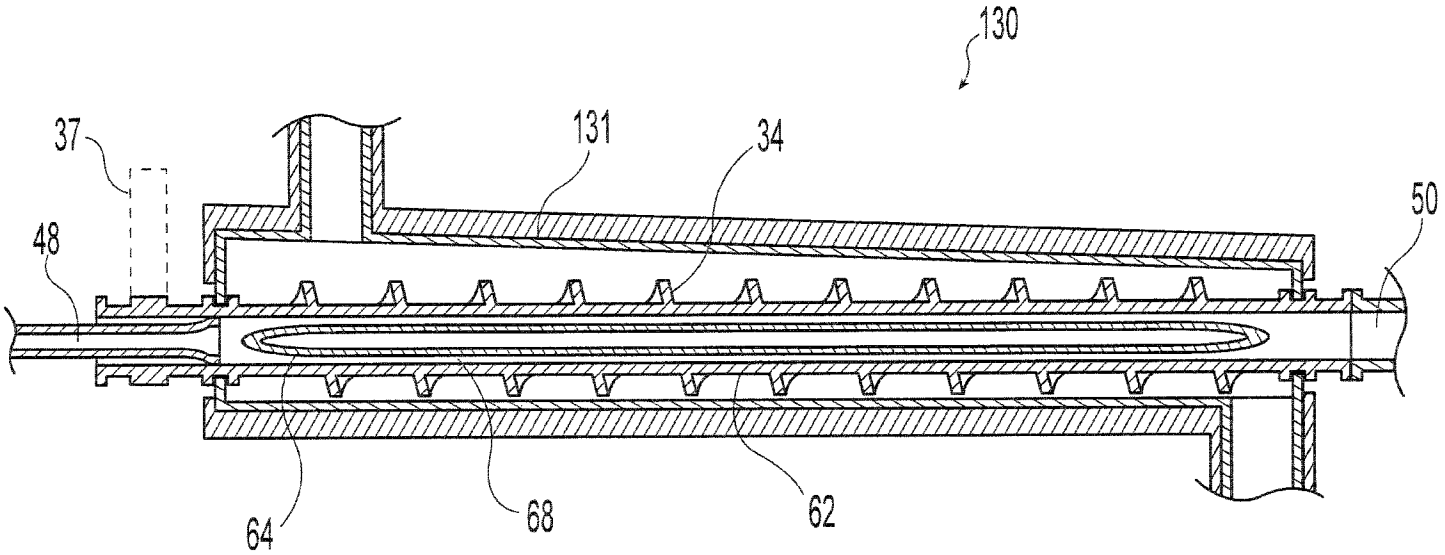
FIG. 13 is a longitudinal cross sectional view through an eighth embodiment of a compacting pyrolyzer of the present disclosure.

In another alternate compacting embodiment shown in FIG. 13, the tapered pyrolyzer furnace 130 comprises at least two of the drive screws 34, laterally positioned adjacent and interleaved, and being capable of conveying coal-bearing material containing volatile materials through the pyrolyzer furnace 130 and plasticizing coal in the coal-bearing material. In the embodiment of FIG. 13, the drive screws 34 comprise hollow drive shafts 62 in communication with and heated by combustion fluid exhausted from the combustion chamber 42. Two drive screws 34 are driven in a direction to move the coal-bearing material through the pyrolyzer furnace 130.

In this embodiment, the pyrolyzer furnace 130 comprises a tapering volume above the drive screws 34. The volume above the drive screws 34 provides a space for coal-bearing material 14, including coal particles to expand above the drive screws 34 as the temperature of the coal-bearing material increases and the volatile materials are fluidized and plasticizing coal in the coal-bearing material. In the embodiment of FIG. 13, the volume above the drive screws has a longitudinal taper with a reducing cross sectional area along the length of the pyrolyzer furnace housing 131 in the direction of travel of the coal-bearing material.

Thus, in this embodiment, the portion of the pyrolyzer furnace 130 through which the coal-bearing material moves has a decreasing volume along the length of the pyrolyzer. As coal-bearing material 1 containing volatile materials convey through the pyrolyzer of this embodiment, the coal-bearing material is forced into the reducing volume of the pyrolyzer furnace 130 by the drive screws 34, thereby compacting and plasticizing the coal in coal-bearing material as conveyed through the pyrolyzer.

In this embodiment, the diverter 64 is positioned within the hollow drive shafts 62. The diverter 64 comprises the outer surface 66 forming with the inner surface of the drive shaft 62 an inner passageway 68 through the drive shaft 62, capable of diverting and directing heat flux from the heated combustion fluid to adjacent the coal-bearing material moving through the pyrolyzer furnace 230, to fluidize the volatile material therein and plasticizing coal in the coal-bearing material. In one embodiment, the blower 44 moves the exhausted heated combustion fluids from the combustion chamber 42 through the conduit 48 and into the inner passageways 68 of the drive shafts 62 for heating the coal-bearing material moving through the pyrolyzer furnace 130.

Figure 14:
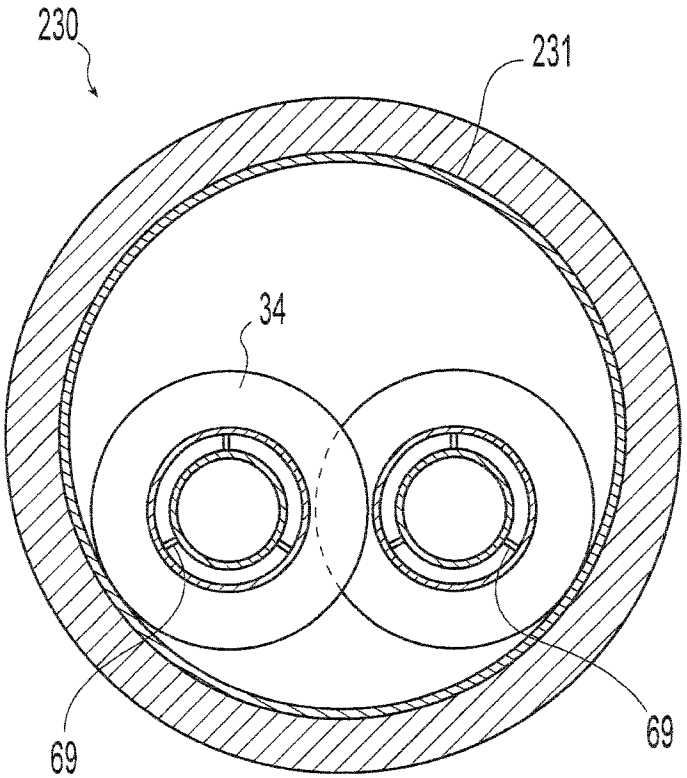
FIG. 14 is a longitudinal cross sectional view through a ninth embodiment of a rotatable pyrolyzer of the present disclosure.

In the embodiment of FIG. 14, a pyrolyzer furnace 230 has a rotatable outer wall at least partially covered by an insulating layer 60. At least two drive screws 34 is laterally positioned adjacent and overlapping, and capable of conveying coal-bearing material containing volatile materials 28 through the pyrolyzer furnace 230, are rotatably mounted within the pyrolyzer furnace for conveying the coal or coal-bearing material 14, including coal particles, through the pyrolyzer.

In the embodiment of FIG. 14, the pyrolyzer furnace 230 comprises a generally cylindrical pyrolyzer furnace housing 231, where at least a portion of the pyrolyzer furnace housing 231 is rotatably driven about its longitudinal axis. The end walls of the cylindrical furnace may be fixed relative to the rotating cylindrical portion. In this embodiment, the drive screws may be supported by non-rotating end walls or other non-rotating portion of the pyrolyzer furnace 230.

In this embodiment, each drive screw 34 may rotate about its longitudinal axis, and the pyrolyzer furnace outer wall may rotate about its longitudinal axis. The longitudinal axes of the screws and the pyrolyzer furnace may be oriented in a fixed relationship. At least a portion of the pyrolyzer furnace housing 231 may be rotatable around the drive screws 34.

In the embodiment of FIG. 14, it is contemplated that the pyrolyzer furnace 230 may comprise a double outer wall forming a heating jacket (not shown) in the pyrolyzer furnace housing 231 at least partially around the drive screws 34. Such a double outer wall forms an outer passageway between the outer walls capable of conveying a flow of heated fluid adjacent to the coal-bearing material moving through the pyrolyzer furnace to direct heat flux to coal-bearing material fluidize the volatile materials therein and plasticizing coal in the coal-bearing material. In one embodiment, heated combustion fluid may be directed into the double wall cavity through a conduit, plenum or other channel through the non-rotating portion of the pyrolyzer furnace 230.

As shown in FIG. 14, each drive screw 34 may comprise a hollow drive shaft 62 in communication with the combustion chamber 42. The diverter 64 is positioned within the hollow drive shafts 62. The diverter 64 comprises the outer surface 66 forming with an inner surface of the drive shaft 62 an inner passageway 68 capable of diverting heated fluid adjacent the coal-bearing material moving through the pyrolyzer furnace 230, to fluidize the volatile material 28 therein to improve the heat flux efficiency between the combustion fluid and the coal-bearing material to fluidize volatile material in the coal-bearing material and plasticize coal in the coal-bearing material. The blower 44 may move the exhausted combustion fluids from the combustion chamber 42 through the conduit 48 and into the inner passageways 68 for direct heat flux to the coal or coal-bearing material moving through the pyrolyzer furnace 230. The location, size, and shape of the inner passageways 68 may be varied to cause the flow of heated fluid through said passageways to have a turbulent flow having a Reynolds Number greater than 4000 to improve heat flux.

The conduit 48 connects the combustion chamber 42 with the drive shafts 62. The combustion chamber 42 is capable of combusting fluidized volatile materials 28 and/or other hydrocarbon fuels, and exhausting combustion fluids through the inner passageways 68. In one embodiment, the blower 44 moves exhausted combustion fluids through the conduit 48 and through the inner passageways 68.

The diverter 64 may be centered within the hollow drive shaft 62 by a plurality of ribs 69 extending along the outer surface 66. The ribs may extend continuously the length of the diverter. Alternately, a plurality of small ribs holds the diverter in place. In one embodiment, the ribs 69 have an airfoil shape. If desired, the ribs 69 may be shaped and positioned to disrupt flow of gas through the inner passageway 68 for creating turbulent flow to improve heat flux. The ends of the diverter 64 may be tapered. Alternately, the ends of the diverter may be flat, spherical, or any other shape suitable for directing flow into the inner passageways 68 and improving heat flux efficiency.

Figure 15:
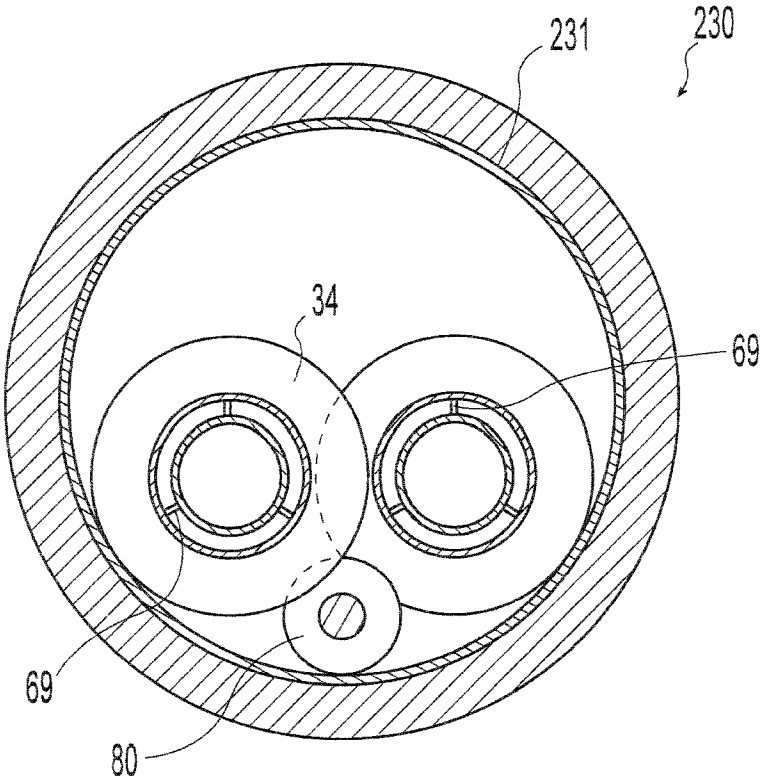
FIG. 15 is a longitudinal cross sectional view through a tenth embodiment of a rotatable pyrolyzer of the present disclosure.

As shown in FIGS. 14 and 15, the insulating layer 60 may be a ceramic or other high temperature insulative material. The insulating layer 60 may be a fabricated structure, a wrapped insulation blanket, a sprayed-on insulative material, or any other insulative or composite material around the pyrolyzer furnace 230.

In one rotatable furnace embodiment shown in FIG. 15, the pyrolyzer furnace 230 may comprise at least three screws laterally positioned adjacent and overlapping, the screws being positioned such that each screw overlaps at least two other screws. Two larger drive screws 34 are provided, and one small screw 80 is provided having a smaller diameter than an adjacent drive screw 34. The small screw may be a clearing screw or a drive screw. It is contemplated that alternate embodiments (not shown) may comprise more than two larger drive screws 34 and at least two smaller screws 80 arranged to convey fine coal particles to coal-bearing material within the rotatable pyrolyzer furnace 230. Alternatively, the smaller screws may be used to clear coal-bearing material from the drive screws as the coal in the coal-bearing swells.

In one embodiment, small screw 80 comprises a hollow drive shaft and a diverter, the hollow drive shaft being in communication with and heated by the combustion fluids from combustion chamber 42, as disclosed above with reference to the larger drive screws 34.

The char produced in the pyrolyzer furnace 30 may be used in various commercial applications. In some commercial processes, the char may be mixed with supplemental materials, such as silicon or iron ore for use in other processes. The plasticized char may used directly in steel making or further processed into coke for use in a blast furnace. We have found that when the char is in a heated, plastic state within the pyrolyzer, other materials can be added and mixed with the plasticized char. The supplemental materials added to the plasticized char become well-mixed in the char when the char solidifies and cools.

Figure 16:
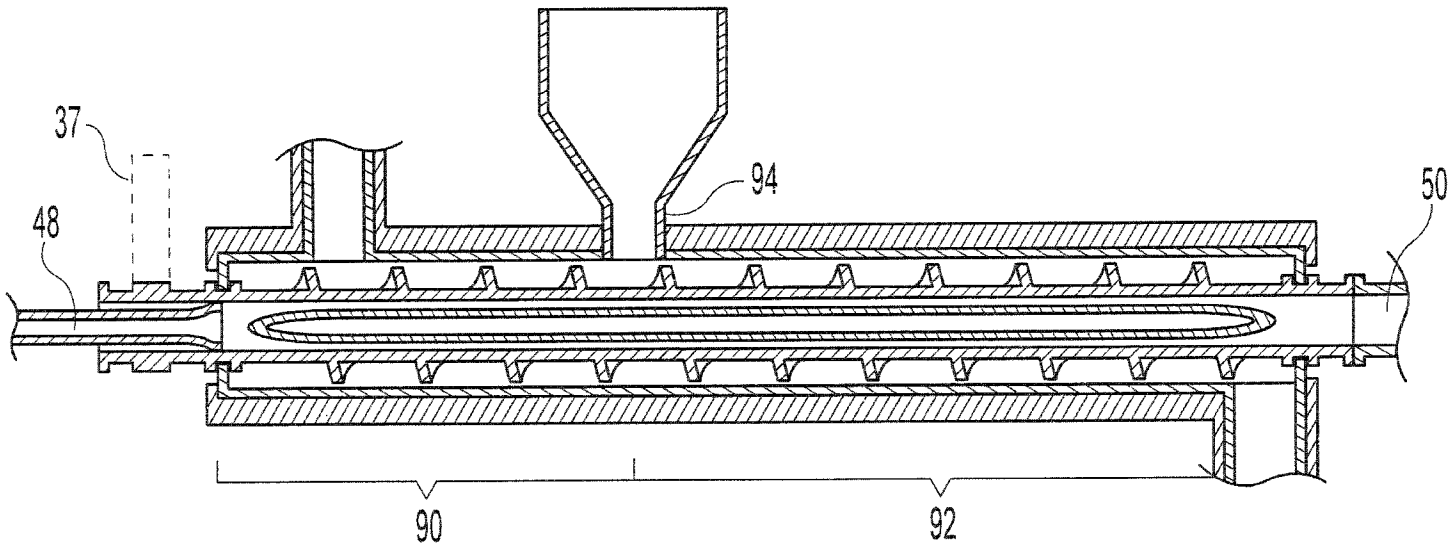
FIG. 16 is a longitudinal cross sectional view through an eleventh embodiment of a pyrolyzer of the present disclosure with mixing capability.

In the embodiment of FIG. 16, the pyrolyzer furnace 30 comprises a first zone 90 capable of fluidizing volatile materials and a second zone 92 capable of mixing supplemental materials such as coal fines into the char. In the embodiment of FIG. 16, a second zone inlet 94 may be provided for introducing supplemental materials into the furnace housing 31. The second zone inlet 94 may be positioned adjacent the beginning of the second zone 92. In this embodiment, the second zone 92 begins at a location where the coal-bearing material in the pyrolyzer furnace becomes molten and plasticized, or at about ⅓ of the length of the pyrolyzer furnace, and the supplemental material may be introduced into the second zone and mixed into the char.

The pyrolyzer furnace of any of the foregoing embodiments may heat the coal-bearing material to a temperature within a range of approximately 650° F. to 1300° F. (approximately 340° C. to 700° C.) to fluidize the volatile materials 28 contained in the coal or coal-bearing material and plasticize coal in the coal-bearing material. In an alternate embodiment, the pyrolyzer furnace 30 heats the coal-bearing material containing volatile materials 28 to a temperature of approximately 1700° F. (approximately 930° C.) or higher. As different volatile materials fluidize at different temperatures and different coals plasticize at different temperatures, it is contemplated that the pyrolyzer furnace 30 may heat the coal-bearing material to a selected temperature for fluidizing the volatile materials within the coal-bearing material and plasticizing coal in the coal-bearing material being processed.

Figure 17A:
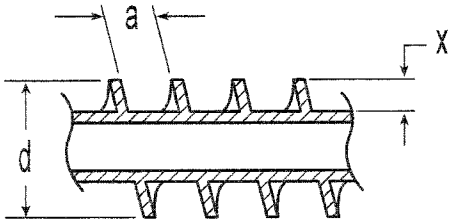
FIGS. 17A and 17B are partial cross sections illustrating two alternate screw flight designs for the pyrolyzer of the present disclosure.
Figure 17B:
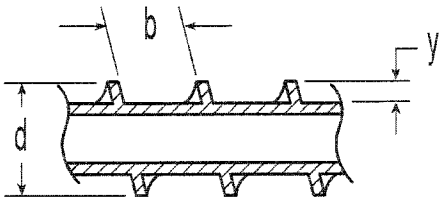

It is contemplated that the screw flights of the drive screws in any of the foregoing embodiments may be varied to process different coal-bearing material and at different rates. For example, for a given screw diameter, a screw flight may have tall, closely spaced flights as illustrated by FIG. 17A, or short, spaced apart flights as illustrated by FIG. 17B. It is contemplated that the screw design may be varied depending on the heat flux properties of different coal or coal-bearing material being processed and desired production capacity.

In any of the foregoing embodiments, it is contemplated that the pyrolyzer may be inclined upwardly in the direction of movement of the coal-bearing material through the pyrolyzer furnace housing. An inclined pyrolyzer furnace may increase heat transfer by providing more surface contact between the coal-bearing material and the pyrolyzer. It is further contemplated that the incline angle may be variable to accommodate processing of different types of bituminous coal. An inclined pyrolyzer may also reduce the amount of floor space used by the pyrolyzer.

The flow of exhausted combustion fluids through the inner passageways 68, formed between the diverter and the inner surface of the hollow drive shaft, may be in the same direction as the drive screws move the coal-bearing material through the pyrolyzer furnace housing. Alternately, the exhausting combustion fluids flow through the inner passageways opposite the direction of the coal-bearing material moving through the pyrolyzer furnace.

When some coal-bearing material c are heated in a pyrolyzer to a temperature sufficient to fluidize volatile materials, the coal or coal-bearing material transitions to a plastic stage. Some coals in a plastic stage have high viscosity, tar-like adhesive properties that cause the material to drag or stick to the screw flights. In one char making apparatus, one drive screw has a different screw pitch than an adjacent screw, and positioned such that one screw wipes material from other screw. Also, the drive screws 34 may be able to be reversed in rotation, or driven at different rotational speeds, to assist in keeping the drive screws 34 free of processed coal and coal-bearing material.

It is contemplated that the pitch of a screw may change along the length of the screw to accommodate the coal-bearing material in a solid state at the entry end of the furnace to a plastic state within the furnace to forming char.

Water may be introduced into any of the foregoing pyrolyzer furnace embodiments for partial gasification of the coal in coal-bearing material in the furnace. In one embodiment, water is introduced into the pyrolyzer furnace where the coal in coal-bearing material containing volatile materials reaches a temperature to fluidize the volatile materials and plasticize coal in the coal-bearing material. The water may react with the fluidized volatile materials for producing carbon monoxide and hydrogen compounds such as hydrogen gas and methane in addition to char.

It is contemplated that the fluidized volatile materials 28 removed from the coal-bearing material may be sufficient to fuel the burners 46 in the combustion chamber 42 without supplemental fuel. However, it is further contemplated that some coal-bearing material may not devolatilize a sufficient amount of volatile material to fuel the combustion chamber 42, at least when starting a pyrolyzer furnace campaign. The hydrogen produced from the introduction of water may be used to additionally fuel the combustion chamber 42.

By the pyrolyzer furnace, various carbon and hydrocarbon-bearing products, such as municipal waste, organic material, tires, hydrocarbon sludge, tar sand, oil shale, coal fines and other carbon-bearing materials may be effectively processed to heat the coal-bearing material and transfer the coal-bearing material into char.

Figure 18:
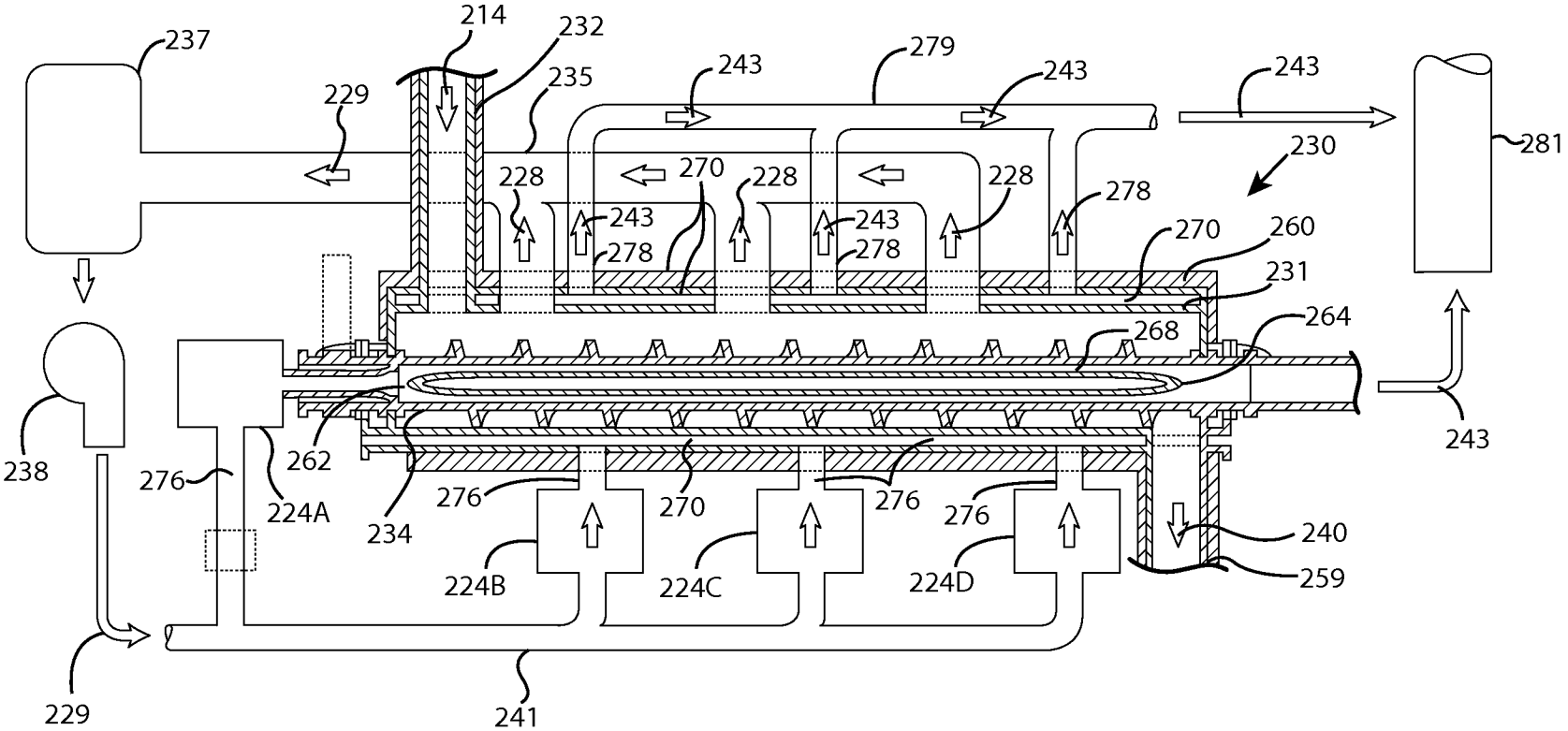
FIG. 18 is a longitudinal cross sectional view through a twelfth embodiment of a pyrolyzer of the present disclosure with mixing capability and combustion chambers.

With reference to FIG. 18, an additional embodiment of a pyrolyzer furnace 230 is shown. In this embodiment, coal-bearing material 214 is delivered to the pyrolyzer furnace housing 231 through screw feeder 232 where the material 214 engages the interleaved pair of drive screws 234 and is processed into char 240 which is delivered through an output 259 to a char cooler or the like. During the charring process, fluidized volatile materials 228 are released from the coal-bearing material 214 to be processed in the combustion chamber into combustion fluids. The fluidized volatile materials 228 are removed from the pyrolyzer furnace housing 231 through an exhaust duct 235 and transferred to a plenum 237 that collects, stores, and provides a relatively steady flow of fluidized volatile materials 228 to a booster pump 238 that pressurizes the coal gas 229.

Pressurized fluidized volatile material 229 from the booster pump 238 is transferred to a manifold 241 that feeds a number of combustion chambers 224A-D (referred to generally as 224) each having a combustion burner (not shown). The combustion chambers 224 receive the pressurized fluidized volatile material 229 from the manifold 241 and combust it to produce combustion fluids 243 that flow through conduits 276 to the hollow drive shaft 262 typically in both of the interleaved drive screws 234 and to a heating jacket 270 having insulating layer 260 round the pyrolyzer housing 231. The combustion fluids 243 flow through the heating jacket 270 and are exhausted through exit conduits 278 in fluid communication with a waste gas header 279. The waste gas header 279 communicates with a waste gas stack 281 for exhausting the combustion fluids 243 to the atmosphere or additional treatment facility.

According to the embodiment illustrated in FIG. 18, the pyrolyzer furnace 230 includes four combustion chambers 224, labeled 224A-D. In this embodiment, a first burner 224A is positioned adjacent one or both of the hollow drive shafts 262 extending through typically both of the interleaved drive screws 234. The combustion chamber 224A receives fluidized volatile material 229 from manifold 241 and combusts it to produce heated combustion fluid 243. This heated combustion fluid 243 is moved through the hollow drive shafts 262 where it is diverted to the inner passageways 268 by the diverters 264, thereby improving heat flux to the coal-bearing material 214 moving through the interleaved pair of drive screws 234 to heat the coal-bearing material 214 moving through the pyrolyzer furnace housing 231.

Similarly, combustion chambers 224B-224D receive fluidized volatile material 229 through manifold 241 and combusts the fluidized volatile material 229 to produce heated combustion fluid 243. This heated combustion fluid 243 is moved through heating jacket 270, thereby also heating coal-bearing material 214 moving through the interleaved pair of drive screws 234. As shown in FIGS. 18 and 19A-D, heating jacket 270 is formed with the insulating layer 260 and surrounds the pyrolyzer furnace housing 231. This heating jacket 270 is in fluid communication with combustion chambers 224B-D through manifold conduits 276. The combustion chambers 224B-D combust fluidized volatile material 229 received through manifold 241 and move heated combustion fluid 243 through the manifold conduit 276 into the heating jacket 270. Flow controllers 245 are positioned within the heating jacket (FIG. 19B) to direct the combustion gases 243 through the heating jacket 270 in a preferred flow pattern to exhaust through exit conduits 278 positioned connected to heating jacket 270 opposite combustion chambers 224 B-D.

The combustion gases 243 exhausted through the exit conduits 278 are in fluid communication with waste gas header 279.

Figure 19A:
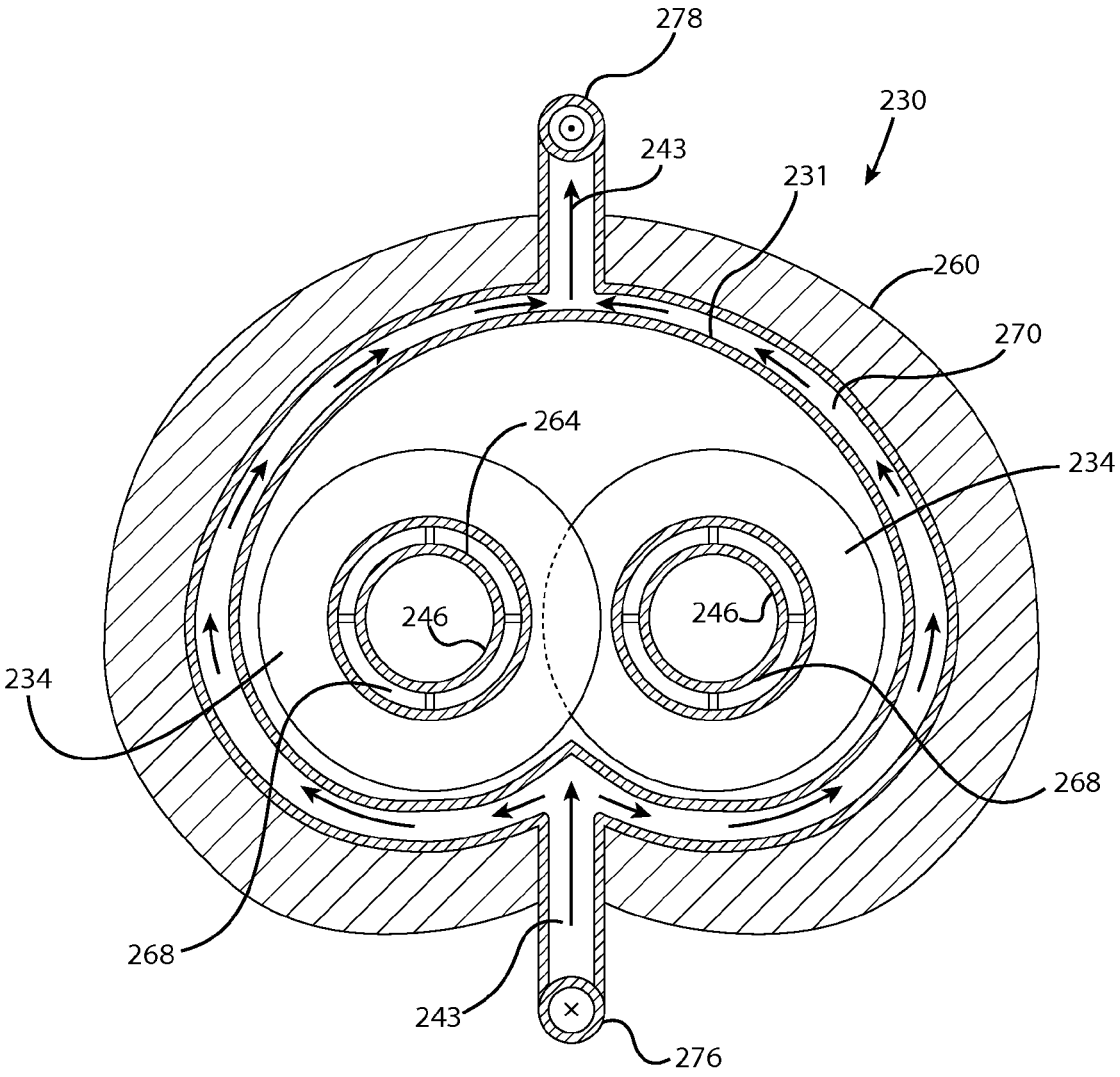
FIGS. 19A-C are partial cross-sectional views illustrating alternate arrangements of a heating jacket.
Figure 19B:
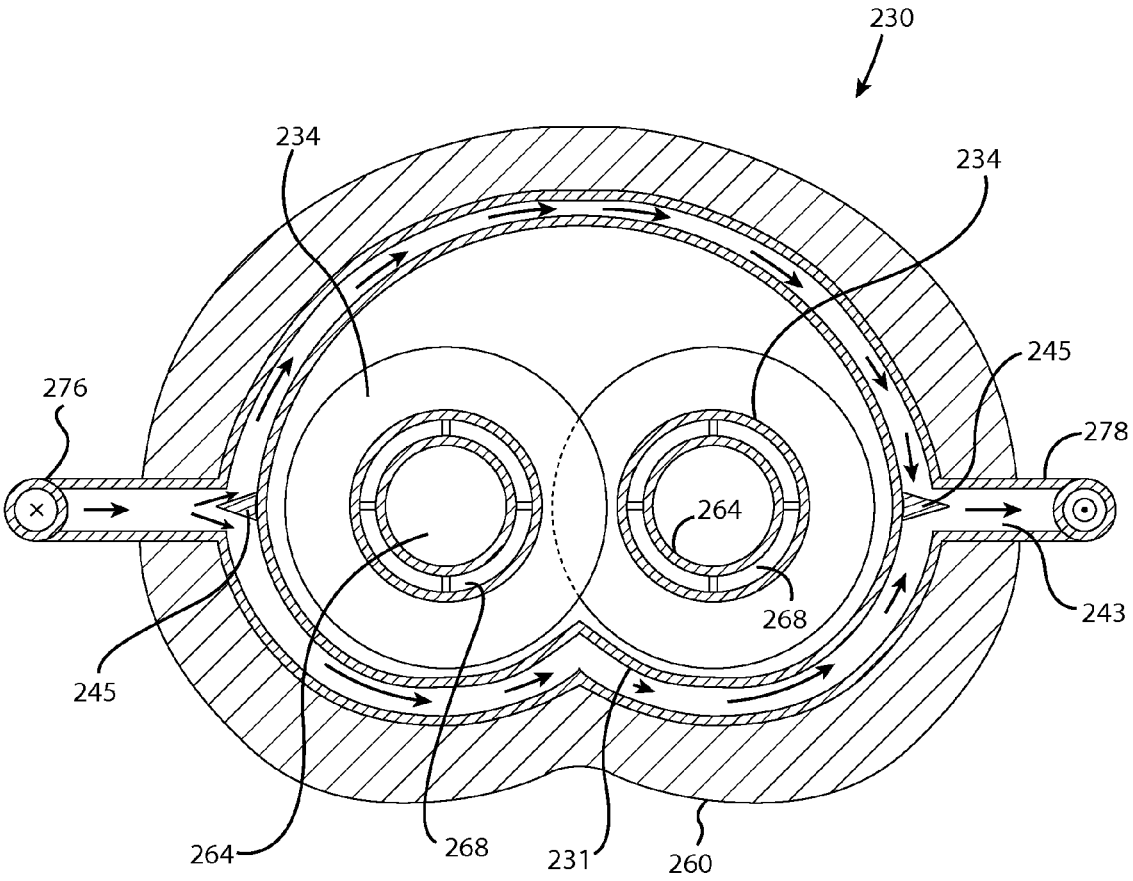
Figure 19C:
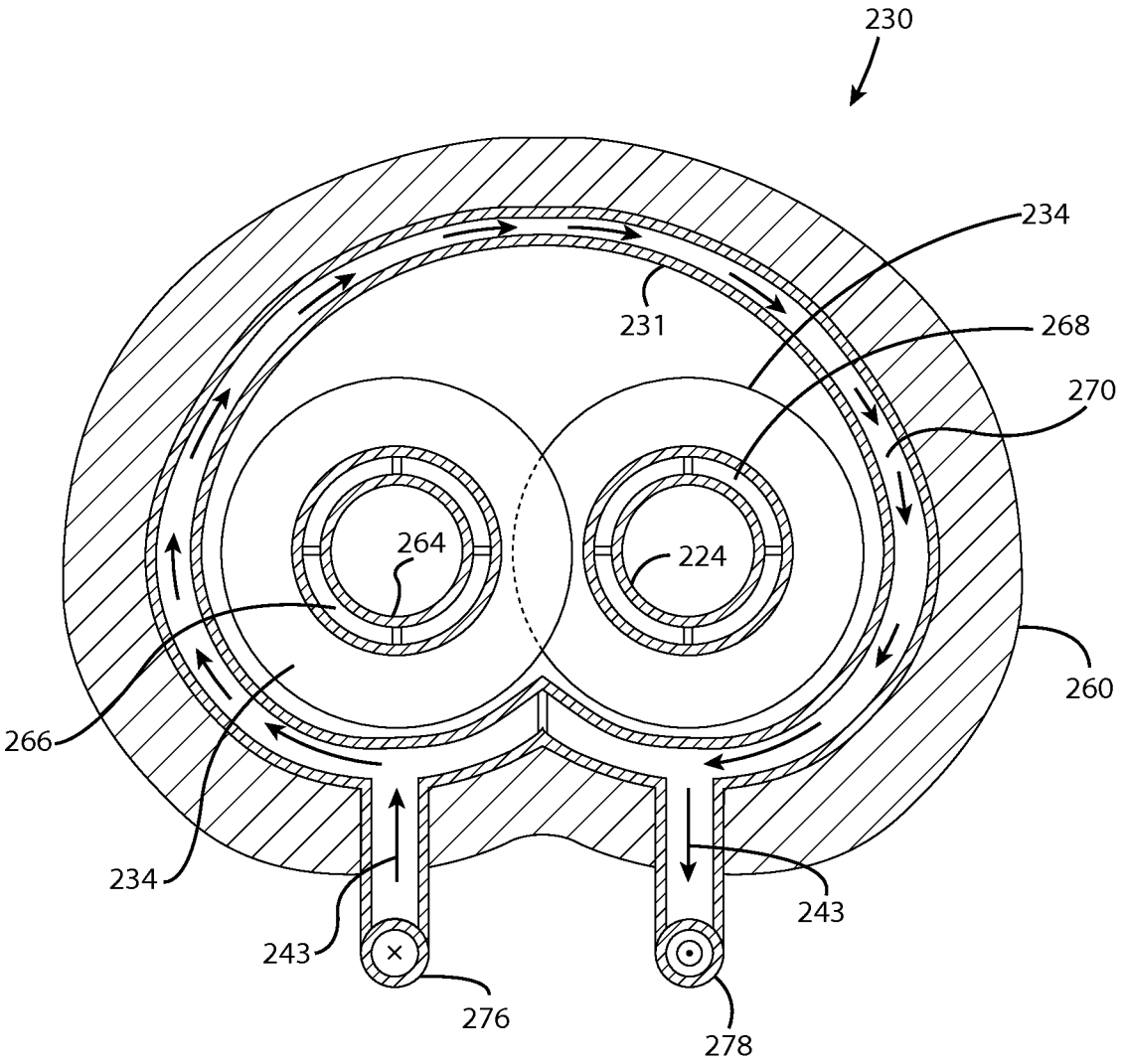

In the embodiment illustrated in FIGS. 18 and 19A, combustion fluid 243 enters the heating jacket 270 at the underside of the pyrolyzer furnace housing 231, passes through the manifold conduits 276 and exits the upper side of the pyrolyzer furnace housing 231 through the exit conduits 278. As illustrated in FIG. 19B, the combustion fluid 243 may enter one or the other side of the furnace housing 231 and exit from the opposite side of the furnace housing 231. Alternatively, as shown in FIG. 19C, the manifold conduit 276 and exit conduit 278 may be positioned to provide any desired path flow pattern using flow controllers 245 directing heat flux from the combustion fluid 243 to the coal-bearing material moving through the pyrolyzer furnace housing 231, as desired Other arrangements and variations are contemplated and will be apparent from the desired heat distribution through the jacket 270 to the coal-bearing material moving through the pyrolyzer furnace housing 231

According to one embodiment of the system illustrated in FIGS. 18 and 19A, the flow controllers 245 are positioned so that combustion gas flows more evenly around the heating jacket 270 and the heat flows through the pyrolyzer furnace housing 231 to the coal-bearing material is symmetrical within the heating jack 270. According to alternative embodiments, flow controllers 245 may direct more or less combustion fluid 243 in one direction or another, providing desired heat flux distribution about coal-bearing material moving through the furnace housing within the jacket 270.

In all of these embodiments, heat flux provided to the coal or coal-bearing material 214 from the combustion fluid 243 moving through the inner passageways 268 and the heating jacket 270 cause the coal-bearing material 214 moving through the pyrolyzer furnace housing 231 to fluidize volatiles in the coal-bearing material and plasticize coal in the coal-bearing material to form char 240. The combustion fluid 243, with heat reduced, is then exhausted from hollow shafts 262 and heating jacket 270.

Figure 20:
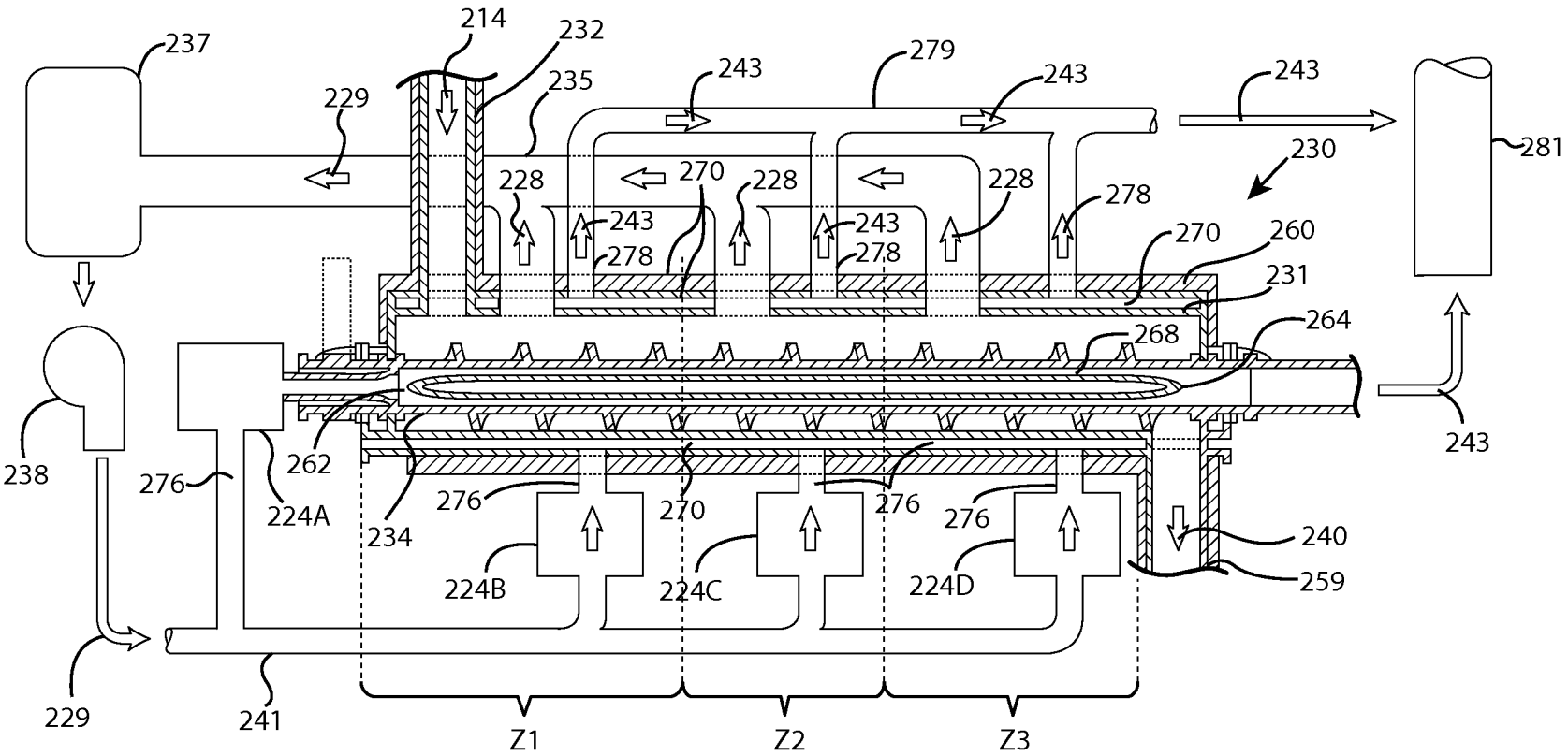
FIG. 20 is a longitudinal cross sectional view through a thirteenth embodiment of a pyrolyzer of the present disclosure with mixing capability, combustion chambers, and heating zones.

With reference to FIG. 20, another embodiment of the improved pyrolyzer is shown. In this embodiment, the heating jacket 270 is separated by dividers 271 into separate heating zones, $Z_1$, $Z_2$, and $Z_3$. The first zone $Z_1$ extends from the screw feeder 232 to a first divider 271A; the second zone $Z_2$ from the first divider 271A to a second divider 271B; and the third zone $Z_3$ from the second divider to the output 259. Each of these three heating zones may be independently controlled by the amount of heating of combustion fluids 243 by burning fluidized volatiles material with combustion chambers 224B, 224C, and 224D. The heating zones are positioned to provide different levels of heat flux to the coal-bearing material 214 as it moves through the length of the interleaved pair of drive screws 234. The coal-bearing material 214 may travel at different desired rates as the coal-bearing material moves through the different zones along the interleaved pair of drive screws 234, and thereby be exposed to controlled heat flux levels in each of the heating zones for predetermined amounts of time. The dividers 271 may be positioned and insulated to inhibit heat transfer between adjacent zones and ensure proper heat flux levels within each of the zones.

According to the illustrated embodiment, the first combustion chamber 224B provides combustion fluid to the first zone $Z_1$ at a first temperature and heat flux rate to efficiently fluidize the volatiles in the coal-bearing material. This first temperature is selected to heat the coal-bearing material 214 to temperature, e.g. 600-700° F., to efficiently result in a large amount of volatile materials in the coal-bearing material being released as gas or particulate, becoming fluidized in the atmosphere above the coal or coal-bearing material in the furnace housing 231. These fluidized volatile materials are captured and conveyed by duct 235 to the plenum 237.

Further according to embodiment illustrated in FIG. 20, the second combustion chamber 224C provides heated combustion fluid to the second zone $Z_2$ at a second temperature and heat flux rate to efficiently plasticize coal in the coal-bearing material 214. This second temperature is selected to maintain the temperature of the coal-bearing material 214 at a temperature of 650° F. and above, causing the coal or coal-bearing material to be efficiently plasticized and further release volatile materials into the surrounding atmosphere. The heat flux of this second zone $Z_2$ is selected and maintained to raise the temperature of the coal-bearing material 214 and provide for fluidizing the volatile materials and plasticizing coal in the coal bearing material 214. The fluidized volatile materials are captured by the conduit duct 235 and conveyed to the plenum 237. The amount of fluidized volatile materials released in the second zone $Z_2$ may be greater than that is released in the first zone $Z_1$ of the furnace housing 231.

As the coal in coal-bearing material 214 plasticizes at temperature at approximately 640° F. and above, the coal becomes a high viscosity and adhesive liquid which may contain non-plasticized components of the coal-bearing material. During this plasticization phase, carbon from the coal forms into long chains while hydrogen, oxygen, and contaminants are released as gases or particulate matter. These gases and particulate matter are fluidized into the surrounding atmosphere where they are captured by the conduits 278 and conveyed to the plenum 237.

The plasticized carbon remaining, with most of the volatile materials released, comprises carbon which may agglomerate to devolatized chunks of char as they cool. According to one embodiment, non-coal-bearing material and certain coal that does not plasticize when heated to the plasticization temperature may also be included with the char 240. To explain, as the plasticized coal agglomerates, particles of the non-coal material and non-plasticizing coal may be agglomerated into the plasticized coal. In addition, 20 mesh coal fines may be added to the coal-bearing material along the pyrolyzer housing and may be agglomerated into the plasticized coal, resulting in desirable char.

Finally, the third combustion chamber 224D provides combustion fluid to the third zone $Z_3$ at a third temperature. This third temperature is selected to maintain the coal-bearing material 214 at the plasticization temperature of approximately 650° F. and above. Through this third zone, a large portion of the coal in the coal-bearing material 214 is plasticized and converted into char 240.

In each of the combustion chambers 224, either the temperature or amount of combustion fluid 243 may be regulated. In order to control the temperature of the combustion fluid 243, the combustion chambers 224 may be supplemented as desired to mix the combustion fluid with an outside gas or fuel sources. This mixing may be regulated to produce a desired heat flux in each of the zones, thereby controlling the temperature of the combustion fluid in the heating jacket 270. Alternatively, the amount of combustion fluid 243 provided into the heating jacket 270 in each zone may be varied. By adjusting the rate of consumption of fluidized volatile materials 229 by the burner 224, the amount of heat introduced into the heating jacket 270 through the combustion gas 243 may be varied to control fluidized volatiles in the coal-bearing and plasticize coal in the coal-bearing material to form char 240. As the coal-bearing material 214 draws heat from the combustion fluid, the temperature of each zone may be controlled and fluidization of the volatiles in the coal-bearing and plasticization of coal in the coal-bearing material is controlled.

The embodiment illustrated in FIG. 20 has three separate and distinct heating zones Z, each controlled by one or more separate combustion chambers 224. This embodiment may also refine the shape of the diverter 264 and the inner passageway 268 within the shaft of the drive screws 234 to control the heat flux to the coal-bearing material in each zone Further, a separate combustion chamber may be provided for each drive screw 234 to provide desired temperatures and heat flux.

It is also contemplated that additional zones Z may be provided to establish different regions with different levels of heat flux with different temperatures in the heating jacket 270. It is contemplated that the temperature and heat flux of each individual combustion chamber 224 can be independently and variably controlled.

Figure 21:
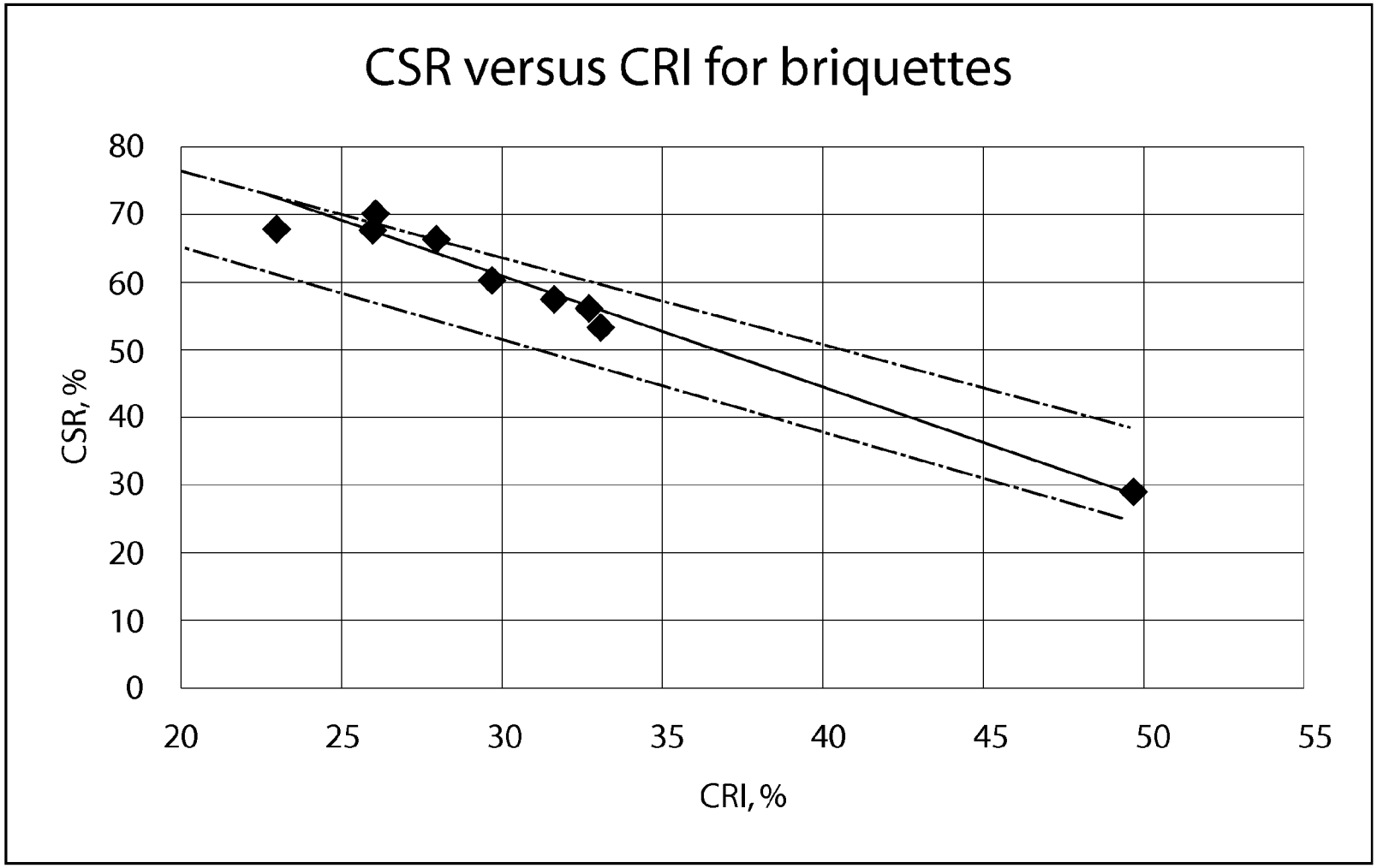
FIG. 21 is a graph illustrating CSR vs. CRI for various tested samples.

In yet another embodiment of the present invention, the char 240 discharged from the pyrolyzer 230 may be combined with a binder coal in order to produce briquetted metallurgical coke. A metallurgical coke is a dense, crush-resistant fuel for use in iron and steel making. According to a one description, metallurgical coke is material having a CRI (Coke Reactivity Index) less than 25% and a CSR (Coke Strength after Reaction) greater than 60%, as defined by ASTM standard D5341-99 (Standard Test Method for Measuring Coke Reactivity Index (CRI) and Coke Strength after Reaction (CSR)). In an alternative description, metallurgical coke is material having CRI and CSR relationship that falls between the dashed lines in FIG. 21.

In the present briquetting process, a coal-bearing material having less than 30% volatile materials is produced to char in the pyrolyzer 230. The char 240 from the pyrolyzer 230 is mixed with a binder coal having a mid or high fluidity as determined by ASTM standard D2639-08 (Standard Test Method for Plastic Properties of Coal by the Constant-Torque Gieseler Plastometer). The binder coal is ground and mixed with the char 240 to form a blend. The blend is then mixed with a binding agent; such as bitumen, asphalt, coal tar pitch, or other petroleum, plant, or animal based viscoelastic polymer; and briquetted. The briquettes are then cured by heating and quenching, thereby producing coke briquettes suitable for metallurgical coke.

The binder coal has a fluidity of at least 2,000 ddpm and less than 15% volatile materials. The briquettes are comprised of 25-75% char, 15-70% binder coal, and less than 20% and generally 5-15% binding agent. The binder coal may have a fluidity of at least 5,000 ddpm and the briquettes comprise at least 60% char, 5% binding agent, and 30% binder coal.

In making the briquettes, coal-bearing material 214 may be ground to, for example, 12 to 20 mesh and processed into char 240 in a twin-screw longitudinal pyrolyzer furnace 230 by the above-described pyrolyzing process. The char 240 is delivered to a hopper for charging to a mill as described below to be mixed with the binder coal.

A binder coal is selected having a mid- to high-fluidity of at least 2,000 ddpm, and may have a fluidity of 5,000-11,000 ddpm or more. A high degree of coal fluidity is desired to provide briquettes with a high CSR value, although lower fluidity coals may also provide a high CSR value. Higher fluidity coals with a lower CSR value may be selected as these coals are seen as less desirable and therefore produce less expensive coke. The binder coal may be ground substantially smaller than the mesh size of the char to, for example, 50 to 70 mesh.

The ground binder coal may be mixed, for example in a tumbler or pug mill mixer, with the char and a binding agent is applied to form a blended material. The blend may comprise 5 to 15% binding agent, 20 to 70% binder coal, and 25 to 70% char or may comprise 6 to 12% binding agent, 20 to 70% binder coal and 35 to 60% char. The mix of char and binder coal will depend on the binder coal selected, with a higher proportion of binder coal likely for coals having a lower fluidity.

The blend is next briquetted in a compression briquetting machine, at, for example, a pressure of 560 to 600 bar, in a briquetting roll. These briquettes may then charged and heated in a furnace and thereafter quenched, thereby producing briquettes suitable for use as metallurgical coke.

EXAMPLES

In various tests of the pyrolyzer and briquetting processes, char was produced in a twin-screw pyrolyzer and briquetted with a binding coal and binding agent and briquetted. The briquettes were carbonized and the strength (CSR) and reactivity (CRI) of the formed coke briquettes were measured according to a modified ASTM D5341-99 standard using uncrushed briquettes.

The char may be formed in the twin-screw pyrolyzer as described above from two different sources of coal-bearing material: Teco Myra coal (described in Appendix A) and Solar Sources coal (described in Appendix B). Each of these coals may be mixed with one of two different binder coals: Virginia Crews (described in Appendix C) and Blue Creek 7 (described in Appendix D). A binding agent, asphalt Shell HV06, was then added to the mixture and the resultant blend was briquetted at 560 to 600 bar in briquetting rolls. Each of the blends comprised 60% char, 30% binder coal, and 10% binding agent.

In order to test the CSR and CRI of the briquettes, the briquettes were carbonized in a Jenkner retort. The retort was preheated to about 600° C. at which point the briquettes were introduced to the oven. The oven was maintained at a constant temperature of about 600° C. for 80 minutes and increased to 1020° C. at a rate of 3° C./h. Finally the briquettes were maintained at 1020° C. for 60 minutes, and then cooled. The CSR and CRI of the briquettes was measured. CS0% is a measurement representing the cold strength of the briquettes as the fraction of pieces greater than 10 mm in size after 600 rotations in an I-drum. The results are reproduced in the following Table 1:

| Briquette Blend | CRI % | CSR % | CS0% |
|---|---|---|---|
| 60% Myra Char<br>30% Poca 3 | 32.6 | 55.8 | 79.3 |
| 60% Myra Char<br>30% Virginia Crews | 25.9 | 67.3 | 88.7 |
| 60% Myra Char<br>30% Blue Creek 7 | 22.9 | 68.2 | 80.2 |
| 60% Myra Char<br>15% Virginia Crews<br>15% Blue Creek 7 | 27.9 | 66.0 | 88.6 |
| 60% High Vol. Myra<br>30% Virginia Crews | 26.0 | 70.3 | 90.3 |
| 60% Solar Sources<br>30% Virginia Crews | 29.6 | 60.1 | 84.5 |
| 60% Solar Sources<br>30% Blue Creek 7 | 33.0 | 53.2 | 80.7 |

A base test to determine the CSR/CRI of the coal briquettes was performed by combining Myra char with Poca 3 binder coal. The CSR and CRI of these briquettes were then determined Various other binding coals were then selected and combined with char produced from either Tyco Myra or Solar Sources coal to form briquettes. The CSR and CRI of these briquettes was recorded and reproduced in the above Table 1. The CSR and CRI tests were carried out on uncrushed briquettes rather than crushed briquettes required by the ASTM standard, and so the comparison between various blends is made with respect to the briquettes formed using Tyco Myra char and Poca 3 binding coal.

These briquettes were formed by crushing the char and bitumen to <1 mm and the binder coal to <0.212 mm separately in laboratory ball mills 4-5 kg of each blend were prepared for briquetting. The blends were fed directly between the rolls of a briquetting machine operated from 560-600 bar to produce well shaped briquettes around 40 g each. The briquettes were next carbonized in a Jenkner retort by introducing the briquettes at 600° C. and keeping them at temperature for 80 minutes. The temperature was then increased to 1020° C. at 3° C./hour and held there for 60 minutes before cooling down.

Once the briquettes had been formed and carbonized, the CSR and CRI of each type of briquette was determined and is reproduced in the above table. From this data, it was found that the binder coal has an important effect on the briquette's reactivity, which may also be dependent on the lump size. Further, higher rank coal, such as Tyco Myra, produces better CSR results than lower rank coals, such as Solar Sources. The volatile matter of the char has a limited effect on the CSR and CRI compared to the effect of the binder coal.

As evidenced by Table 1, the mid-fluidity binder coal, Virginia Crews (2688 ddpm), produced a higher CSR than the low-fluidity Poca 3 (65 ddpm) briquettes. The reactivity of the briquettes was good using a mixture of high-fluidity and low fluidity coal, further evidencing the impact of high fluidity coals as suitable binder coal for producing metallurgical coke briquettes. As seen by Table 1, the blend with low fluidity Poca 3 was short of producing quality metallurgical coke.

Figure 22:
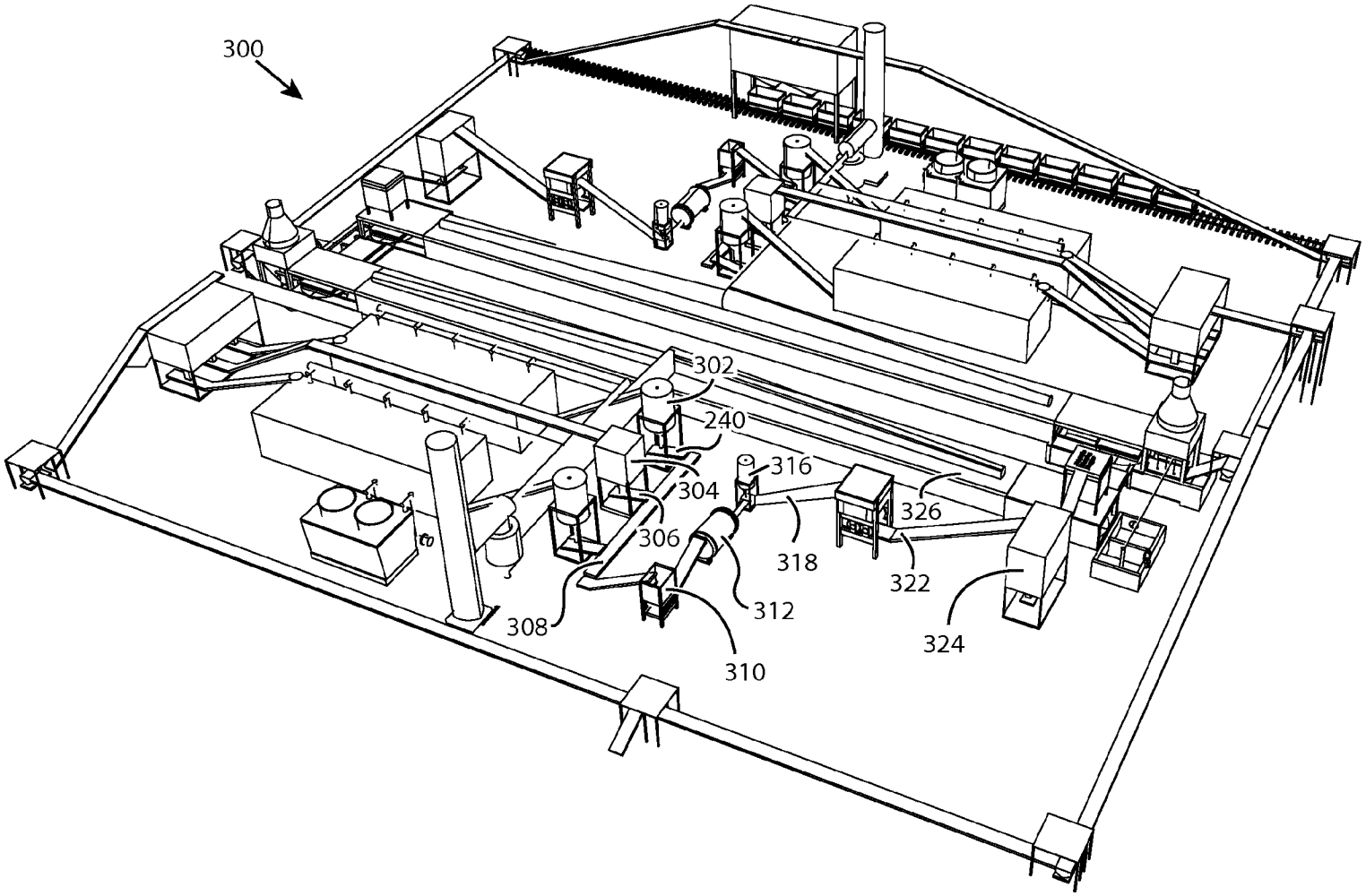
FIG. 22 is a perspective view of a briquetting system according to one aspect of the invention.

Also described in the present system and apparatus 300 to produce metallurgical coke briquettes as illustrated in FIG. 22. In this system, coal-bearing material 214 is provided to a pyrolyzer furnace 230 that produces, through the above-described pyrolyzing process, char 240. The char 240 is delivered from the pyrolyzer to a char hopper 302. A binder coal hopper 304 holds and stores binder coal 306 that is ground to a fine mesh, e.g. less than or equal to 60 mesh.

The binder coal 306 and char 240 are delivered from their respective hoppers 302, 304, onto a conveyor 308 and delivered to a crusher 310, such as a roll crusher, that provide the char 240 and binder coal 306 of an appropriate size, which may be for example less than or equal to 60 mesh. The mixture is next delivered to a mixer 312, such as a pug mill mixer, that an even mix of char and binder coal.

The mixture of binder coal 306 and char 240 is conveyed past a tank 302 containing a binding agent 316 (asphalt), where the mixture is sprayed with the binding agent 316 providing a blend 318 of binding agent 316, binder coal 306 and char 240. The blend 318 may comprise, for example, 10% binding agent, 30% binder coal and 60% char. The mixture may be within the range of 5 to 10% binding agent, 20 to 70% binder coal and 25 to 75 percent char.

The blend 318 is next conveyed to a briquetter 320 to produce briquettes. The briquetter 320 may be a roll press briquetter that conveys the blend 318 into a briquette mold and applies a pressure to the blend 318 in the mold to form briquettes 322. The roll presses may provide, for example, 560 to 600 bar pressure in forming the briquettes. The formed briquettes 322 are transferred to a briquette hopper 324 for storage.

The briquettes 322 in the hopper 324 may be conveyed through a charging furnace 326 and subsequently quenching the briquettes 322. In an elongated charging furnace 326, the temperature of the briquettes 322 is slowly increased to form hot briquettes, before submerging the briquettes into a water bath to quench them. As briquettes 322 are heated to a temperature sufficient to plasticize the binder coal within the briquettes in the furnace 326, fluidized coal is caused to penetrate and strengthen the char to sufficient levels to form metallurgical coke. Further, as the briquettes 322 are heated in furnace 326, volatile materials in the binding agent and binder coal are fluidized and released from the briquettes. These volatile materials may be captured and utilized in the pyrolyzer for heating the coal-bearing material as described above. Alternatively, the volatile materials may be processed to safely be exhausted through a stack, or captured and combusted to provide heating to the charging furnace 326.

The above-described ranges for the char 240, binder coal 306 and binding agent 316 for the blend may be varied depending on the particular compositions of the char 240, binder coal 306 and binding agent 316. For example, because the binding agent 316 may contain a large proportion of volatile materials that will be exhausted from the briquettes during the charging to furnace 326, a lower proportion of binding agent may be provided in the blend 318. By using binder coals 306 having a higher level of fluidity, the amount of binding agent 316 required to bind the briquettes may be reduced to approximately 6 to 12%, depending on the coal composition. Very high levels of binder coal 306 fluidity may therefore be desired, to approximately 11,000 ddpm, reducing the preferred level of binding agent 316 in the blend 318.

During the coal charging process the binder coal 306 plasticizes as it reaches the plasticization temperature and penetrates pores in the char 240 to enhance the strength of the briquettes 322. The proportion of char 240 to binder coal 306 should therefore be controlled to provide the strength (CSR) and reactivity (CRI) of the briquettes at a desired level. The blend may comprise 35 to 65% char 240, with the remainder being binder coal 306 and binding agent. The proportion of char to binder coal may be, as with the binding agent, variable depending on the fluidity of the binder coal. A binder coal having a very high fluidity may be used with a high proportion of char. However, binder coals having a lower fluidity may tend to have a higher CSR, and therefore a lower proportion of char is usually appropriate to provide the threshold CSR values for metallurgical coke.

While the invention has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalence thereof.

APPENDIX A

| Name | Tyco Myra |
|---|---|
| Proximate Analysis | |
| Moisture (%) | — |
| Ash (%/s) | 8.7 |
| Volatile Materials (%/s) | 35.2 |
| Volatile Materials (%/p) | 38.55421 |
| Fixed Carbon | 56.1 |

APPENDIX A-continued

| Ultimate Analysis | |
|---|---|
| Carbon (%/s) | 78.3 |
| Hydrogen (%/s) | 5.07 |
| Oxygene (%/s) | 7 |
| Nitrogen (%/s) | 1.54 |
| Sulfur (%/s) | 0.88 |
| Chlorine (%/s) | 0.18 |
| Coking Properties Dilatometer Test | |
| T1 (° C.) | 374 |
| T2 (° C.) | 415 |
| T3 (° C.) | 439 |
| Concentration (%) | −25 |
| Dilation (%) | 21 |
| General Factor (—) | — |
| Plasticity | |
| T1 (° C.) | 392 |
| T2 (° C.) | 428 |
| T3 (° C.) | 461 |
| Max Fluidity | 584 |
| Maceral Analysis (measures) | |
| Vitrinite (%) | 73.3 |
| Exinite (%) | 9.9 |
| Inertinite | 8.6 |
| Semi-Fusinite | 2.6 |
| Fusinite | 0.6 |
| Other | 0 |
| Mineral Calc. (%) | 5.097 |
| Ash Analysis | |
| Provider (—) | Socor |
| SiO2 (%) | 54.5 |
| Al2O3 (%) | 30.6 |
| CaO (%) | 1.8 |
| MgO (%) | 0.8 |
| TiO2 (%) | 1.6 |
| Na2O (%) | 0.7 |
| K2O (%) | 3.2 |
| Fe2O3 (%) | 6.1 |
| Mn3O4 (%) | 0.1 |
| P2O5 (%) | 0.2 |
| SO3 (%) | 0.5 |
| Physical Properties Granularity | |
| <21 mm (%) | — |
| <19 mm (%) | — |
| <16 mm (%) | — |
| <10 mm (%) | 100 |
| <5 mm (%) | 96.4 |
| <3.15 mm (%) | 89.5 |
| <2 mm (%) | 75.4 |
| <1 mm (%) | 51.6 |
| <0.5 mm (%) | 32.6 |
| <0.2 mm (%) | 15.8 |
| <0.16 mm (%) | 13.1 |
| <0.1 mm (%) | — |

APPENDIX B

| Name | Solar Sources |
|---|---|
| Proximate Analysis | |
| Moisture (%) | — |
| Ash (%/s) | 8.6 |
| Volatile Materials (%/s) | 35.6 |
| Volatile Materials (%/p) | 38.94967 |
| Fixed Carbon | 55.8 |
| Ultimate Analysis | |
| Carbon (%/s) | 76.7 |
| Hydrogen (%/s) | 4.61 |

APPENDIX B-continued

| | |
|---|---|
| Oxygene (%/s) | 7.9 |
| Nitrogen (%/s) | 1.45 |
| Sulfur (%/s) | 0.85 |
| Chlorine (%/s) | 0.03 |
| Coking Properties Dilatometer Test | |
| T1 (° C.) | 342 |
| T2 (° C.) | 409 |
| T3 (° C.) | 434 |
| Concentration (%) | −26 |
| Dilation (%) | 23 |
| General Factor (—) | — |
| Plasticity | |
| T1 (° C.) | 378 |
| T2 (° C.) | 422 |
| T3 (° C.) | 455 |
| Max Fluidity | 767 |
| Maceral Analysis (measures) | |
| Vitrinite (%) | 76.7 |
| Exinite (%) | 4.3 |
| Inertinite | 6.2 |
| Semi-Fusinite | 3.3 |
| Fusinite | 4.5 |
| Other | 0 |
| Mineral Calc. (%) | 5.036 |
| Ash Analysis | |
| Provider (—) | Socor |
| SiO2 (%) | 46.2 |
| Al2O3 (%) | 20.8 |
| CaO (%) | 12.5 |
| MgO (%) | 0.6 |
| TiO2 (%) | 1.1 |
| Na2O (%) | 0.6 |
| K2O (%) | 2.1 |
| Fe2O3 (%) | 6.6 |
| Mn3O4 (%) | 0.1 |
| P2O5 (%) | 0.2 |
| SO3 (%) | 9.3 |
| Physical Properties Granularity | |
| <21 mm (%) | — |
| <19 mm (%) | — |
| <16 mm (%) | — |
| <10 mm (%) | 100 |
| <5 mm (%) | 97.3 |
| <3.15 mm (%) | 89.2 |
| <2 mm (%) | 75.5 |
| <1 mm (%) | 50.9 |
| <0.5 mm (%) | 32.1 |
| <0.2 mm (%) | 15.3 |
| <0.16 mm (%) | 12.7 |
| <0.1 mm (%) | — |

APPENDIX C

| Name | Poca 3 |
|---|---|
| Proximate Analysis | |
| Moisture (%) | — |
| Ash (%/s) | 7.8 |
| Volatile Materials (%/s) | 16.4 |
| Volatile Materials (%/p) | 7.78741 |
| Fixed Carbon | — |
| Ultimate Analysis | |
| Carbon (%/s) | — |
| Hydrogen (%/s) | — |
| Oxygene (%/s) | — |
| Nitrogen (%/s) | — |
| Sulfur (%/s) | — |
| Chlorine (%/s) | — |

APPENDIX C-continued

| | |
|---|---|
| Coking Properties | |
| Dilatometer Test | |
| T1 (° C.) | 431 |
| T2 (° C.) | 456 |
| T3 (° C.) | 490 |
| Concentration (%) | −22 |
| Dilation (%) | 63 |
| General Factor (—) | — |
| Plasticity | |
| T1 (° C.) | 459 |
| T2 (° C.) | 477 |
| T3 (° C.) | 504 |
| Max Fluidity | 65 |
| Maceral Analysis (measures) | |
| Vitrinite (%) | 74.5 |
| Exinite (%) | 0 |
| Inertinite | 11.3 |
| Semi-Fusinite | 5.6 |
| Fusinite | 4 |
| Other | 0 |
| Mineral Calc. (%) | 4.548 |
| Ash Analysis | |
| Provider (—) | — |
| SiO2 (%) | — |
| Al2O3 (%) | — |
| CaO (%) | — |
| MgO (%) | — |
| TiO2 (%) | — |
| Na2O (%) | — |
| K2O (%) | — |
| Fe2O3 (%) | — |
| Mn3O4 (%) | — |
| P2O5 (%) | — |
| SO3 (%) | — |
| Physical Properties | |
| Granularity | |
| <21 mm (%) | — |
| <19 mm (%) | — |
| <16 mm (%) | — |
| <10 mm (%) | — |
| <5 mm (%) | — |
| <3.15 mm (%) | — |
| <2 mm (%) | — |
| <1 mm (%) | — |
| <0.5 mm (%) | — |
| <0.2 mm (%) | — |
| <0.16 mm (%) | — |
| <0.1 mm (%) | — |

APPENDIX D

| Name | Virginia Crews |
|---|---|
| Proximate Analysis | |
| Moisture (%) | — |
| Ash (%/s) | 8.5 |
| Volatile Materials (%/s) | 26.1 |
| Volatile Materials (%/p) | 28.52459 |
| Fixed Carbon | — |
| Ultimate Analysis | |
| Carbon (%/s) | — |
| Hydrogen (%/s) | — |
| Oxygene (%/s) | — |
| Nitrogen (%/s) | — |
| Sulfur (%/s) | — |
| Chlorine (%/s) | — |
| Coking Properties | |
| Dilatometer Test | |
| T1 (° C.) | 371 |
| T2 (° C.) | 415 |

APPENDIX D-continued

| | |
|---|---|
| T3 (° C.) | 469 |
| Concentration (%) | −23 |
| Dilation (%) | 180 |
| General Factor (—) | — |
| Plasticity | |
| T1 (° C.) | 395 |
| T2 (° C.) | 447 |
| T3 (° C.) | 492 |
| Max Fluidity | 2688 |
| Maceral Analysis (measures) | |
| Vitrinite (%) | 49.2 |
| Exinite (%) | 3.6 |
| Inertinite | 8.7 |
| Semi-Fusinite | 2.9 |
| Fusinite | 0.2 |
| Other | 0 |
| Mineral Calc. (%) | 5.036 |
| Ash Analysis | |
| Provider (—) | — |
| SiO2 (%) | — |
| Al2O3 (%) | — |
| CaO (%) | — |
| MgO (%) | — |
| TiO2 (%) | — |
| Na2O (%) | — |
| K2O (%) | — |
| Fe2O3 (%) | — |
| Mn3O4 (%) | — |
| P2O5 (%) | — |
| SO3 (%) | — |
| Physical Properties | |
| Granularity | |
| <21 mm (%) | — |
| <19 mm (%) | — |
| <16 mm (%) | — |
| <10 mm (%) | — |
| <5 mm (%) | — |
| <3.15 mm (%) | — |
| <2 mm (%) | — |
| <1 mm (%) | — |
| <0.5 mm (%) | — |
| <0.2 mm (%) | — |
| <0.16 mm (%) | — |
| <0.1 mm (%) | — |

APPENDIX E

| Name | Blue Creek 7 |
|---|---|
| Proximate Analysis | |
| Moisture (%) | — |
| Ash (%/s) | 9.2 |
| Volatile Materials (%/s) | 19.8 |
| Volatile Materials (%/p) | 21.80616 |
| Fixed Carbon | — |
| Ultimate Analysis | |
| Carbon (%/s) | — |
| Hydrogen (%/s) | — |
| Oxygene (%/s) | — |
| Nitrogen (%/s) | — |
| Sulfur (%/s) | — |
| Chlorine (%/s) | — |
| Coking Properties | |
| Dilatometer Test | |
| T1 (° C.) | 414 |
| T2 (° C.) | 441 |
| T3 (° C.) | 486 |
| Concentration (%) | −18 |
| Dilation (%) | 120 |
| General Factor (—) | — |

APPENDIX E-continued

| Plasticity | |
|---|---|
| T1 (° C.) | 415 |
| T2 (° C.) | 469 |
| T3 (° C.) | 500 |
| Max Fluidity | 719 |
| **Maceral Analysis (measures)** | |
| Vitrinite (%) | 80.6 |
| Exinite (%) | 0.2 |
| Inertinite | 7.8 |
| Semi-Fusinite | 5 |
| Fusinite | 1 |
| Other | 0 |
| Mineral Calc. (%) | 5.402 |
| **Ash Analysis** | |
| Provider (—) | — |
| SiO2 (%) | — |
| Al2O3 (%) | — |
| CaO (%) | — |
| MgO (%) | — |
| TiO2 (%) | — |
| Na2O (%) | — |
| K2O (%) | — |
| Fe2O3 (%) | — |
| Mn3O4 (%) | — |
| P2O5 (%) | — |
| SO3 (%) | — |
| **Physical Properties Granularity** | |
| <21 mm (%) | — |
| <19 mm (%) | — |
| <16 mm (%) | — |
| <10 mm (%) | — |
| <5 mm (%) | — |
| <3.15 mm (%) | — |
| <2 mm (%) | — |
| <1 mm (%) | — |
| <0.5 mm (%) | — |
| <0.2 mm (%) | — |
| <0.16 mm (%) | — |
| <0.1 mm (%) | — |

What is claimed is:

1. A char making apparatus comprising:

a. a longitudinal pyrolyzer furnace housing wherein coal-bearing material containing volatile materials may be heated to a temperature to fluidize volatile materials therein and plasticize coal in the coal-bearing material;

b. at least two rotatable drive screws laterally positioned and interleaved within the longitudinal furnace housing and capable of conveying coal-bearing materials containing volatile material through the pyrolyzer furnace housing, each drive screw having a hollow drive shaft and a diverter longitudinally positioned within the drive shaft, the diverter forming with an inner surface of each drive shaft an inner passageway to provide heat flux from the combustion fluid moving through the shaft to adjacent coal-bearing materials moving through the pyrolyzer furnace housing to enable fluidizing the volatile material therein and plasticizing coal in the coal bearing material;

c. a heating jacket about the longitudinal furnace housing along at least a portion thereof in fluid communication with combustion fluid from multiple combustion chambers to provide heat flux from the combustion fluid moving through the heating jacket to heat adjacent coal-bearing materials moving through the pyrolyzer furnace housing to fluidize the volatile material in the coal bearing material and plasticize the coal in the coal bearing material;

d. multiple combustion chambers adjacent the inner passageways and adjacent the heating jacket capable of burning fluidized combustion material and exhausting combustion fluids through the inner passageways and through the heating jacket to fluidize volatile material in the coal-bearing material and plasticize coal in the coal-bearing material; and e. a conduit capable of collecting and transferring fluidized volatile material exhausted from the pyrolyzer furnace housing to the combustion chambers to be burned.

2. The char making apparatus as claimed in claim 1, where the flow of combustion fluids through the inner passageways within the hollow drive shafts of the drive screws is in the same direction as the drive screws move the coal-bearing materials through the pyrolyzer furnace housing.

3. The char making apparatus as claimed in claim 1, where the combustion chambers are spaced along the pyrolyzer furnace housing to distribute the combustion fluid moving from such combustion chambers through the heating jacket to exhaust ports from the pyrolyzer furnace housing to provide a desired pattern of heat flux from the combustion fluid to the adjacent coal-bearing material moving through the pyrolyzer furnace housing.

4. The char making apparatus as claimed in claim 1, further comprising: flow controllers positioned in the heating jacket capable of diverting the flow of combustion fluid through said heating jacket to provide a desired heat flux pattern to fluidize volatile material in the coal bearing material and plasticize coal in the coal bearing material.

5. The char making apparatus as claimed in claim 3, further comprising: flow controllers positioned in the heating jacket capable of diverting the flow of combustion fluid through said heating jacket to provide a desired heat flux pattern to fluidize volatile material in the coal bearing material and plasticize coal in the coal bearing material.

6. The char making apparatus as claimed in claim 1, further comprising: devices positioned in the inner passageways capable of causing the flow of heated fluid through said passageway to have a Reynolds number greater than 4000.

7. The char making apparatus as claimed in claim 1, where the portion of the pyrolyzer furnace housing downstream through which the coal-bearing material moves has a decreasing cross sectional area in the direction of travel of the coal-bearing material through the pyrolyzer furnace housing to compact the char before exiting the pyrolyzer furnace housing.

8. The char making apparatus as claimed in claim 7, the pyrolyzer furnace housing having a tapered outer wall downstream forming a decreasing cross-sectional area of the portion of the pyrolyzer furnace housing through which the coal-bearing material moves in the direction of travel of the coal-bearing material through the pyrolyzer furnace housing to compact the char before exiting the pyrolyzer furnace housing.

9. The char making apparatus as claimed in claim 7, where the hollow drive shaft through each screw has a tapered outer wall decreasing the cross sectional area of the portion of the pyrolyzer furnace housing through which the coal-bearing material moves in the direction of travel of the coal-bearing material through the pyrolyzer furnace housing to compact the char before exiting the pyrolyzer furnace housing.

10. The char making apparatus as claimed in claim 7, where the pyrolyzer furnace housing has tapered inner walls and the hollow drive shafts of the drive screws have tapered outer walls coordinated to decrease the cross sectional area of the portion of the pyrolyzer furnace housing through which the coal-bearing material moves in the direction of travel of the coal-bearing material through the pyrolyzer furnace to compact the char before exiting the pyrolyzer furnace housing.

11. The char making apparatus as claimed in claim 1, where the heating jacket surrounds at least a portion of the pyrolyzer furnace housing.

12. The char making apparatus as claimed in claim 1, where the heating jacket surrounds the pyrolyzer furnace housing substantially along its length.

13. The char making apparatus as claimed in claim 1, where the char making apparatus is capable of fluidizing volatile materials and plasticizing coal in the coal-bearing material to a temperature in a range of 650° F. to 1300° F.

14. The char making apparatus as claimed in claim 1, where the pyrolyzer furnace housing is capable of being inclined at a variable upwardly angle in the direction of movement of the coal-bearing material through the housing.

15. The char making apparatus as claimed in claim 1, where at least three drive screws are laterally positioned within the pyrolyzer furnace housing, the drive screws being positioned such that each drive screw interleaves at least one other drive screw.

16. The char making apparatus as claimed in claim 15, comprising in addition at least one clearing screw having a smaller diameter positioned longitudinally through the furnace housing adjacent the drive screws and capable of conveying coal-bearing materials from the drive screws through the pyrolyzer furnace housing.

17. The char making apparatus as claimed in claim 1, comprising in addition at least one clearing screw having a smaller diameter positioned longitudinally through the furnace housing adjacent the drive screws and capable of conveying coal-bearing materials from the drive screws through the pyrolyzer furnace housing.

18. The char making apparatus as claimed in claim 1, where the pyrolyzer furnace housing comprises at least two zones along its length, where the heat flux in the first zone is capable of fluidizing volatile materials, and the second zone is capable of mixing supplemental materials into the coal-bearing materials, and the heat flux in the second and/or subsequent zones is capable of plasticizing coal in the coal-bearing material.

19. The char making apparatus as claimed in claim 1, where the pyrolyzer furnace housing comprises at least two zones along its length, where heat flux in the first zone is capable of fluidizing volatile materials, and heat flux in at least one of the subsequent zones is capable of plasticizing coal in the coal-bearing material.

20. A char making apparatus comprising:

a. a longitudinal pyrolyzer furnace housing wherein coal-bearing material containing volatile materials may be heated to a temperature to fluidize volatile materials therein and plasticize coal in the coal bearing material;

b. at least two rotatable drive screws laterally positioned and interleaved within the longitudinal furnace housing, and capable of conveying coal-bearing materials containing volatile materials through the pyrolyzer furnace housing, each drive screw having a hollow drive shaft and a diverter longitudinally positioned within the drive shaft, the diverter forming with an inner surface of each drive shaft an inner passageway adjacent the coal-bearing materials moving through the pyrolyzer furnace housing to provide heat flux from the combustion fluid to the coal-bearing material to fluidize the volatile material therein and plasticize coal in the coal bearing material;

c. double outer walls in the furnace housing at least partially around the rotatable drive screws and forming an outer passageway between the outer walls, the outer passageway capable of moving a combustion fluid adjacent the coal-bearing materials moving through the pyrolyzer furnace housing providing heat flux from the combustion fluid moving through the outer passageways to the coal-bearing material moving through the pyrolyzer furnace housing to fluidize the volatile material in the coal-bearing material and plasticize coal in the coal-bearing material;

d. multiple combustion chambers adjacent the inner passageways and adjacent the outer passageway capable of burning fluidized combustion material and moving combustion fluids through the inner passageways and the outer passageway to fluidized volatile material in the coal-bearing material and plasticizing coal in the coal-bearing material; and e. a conduit capable of collecting and transferring fluidized volatile material exhausted from the pyrolyzer furnace housing to the combustion chambers to be burned.

21. The char making apparatus as claimed in claim 20, where the flow of combustion fluids through the inner and outer passageways is in the same direction as the drive screws move the coal-bearing materials through the pyrolyzer furnace housing.

22. The char making apparatus as claimed in claim 20, where the combustion chambers are spaced along the pyrolyzer furnace housing to distribute the combustion fluid moving from such combustion chambers through the outer passageway to exhaust ports from the pyrolyzer furnace housing to provide a desired pattern of heat flux from the combustion fluid to adjacent coal-bearing material moving through the pyrolyzer furnace housing.

23. The char making apparatus as claimed in claim 20, further comprising: flow controllers positioned in the outer passageway capable of diverting the flow of combustion fluid through said outer passageway to provide a desired heat flux pattern to fluidize volatile material in the coal bearing material and plasticize coal in the coal bearing material.

24. The char making apparatus as claimed in claim 22, further comprising: flow controllers positioned in the outer passageway capable of diverting the flow of combustion fluid through said outer passageway to provide a desired heat flux pattern to fluidize volatile material in the coal bearing material and plasticize coal in the coal bearing material.

25. The char making apparatus as claimed in claim 20, further comprising:

devices positioned in the inner and outer passageways capable of causing the flow of heated fluid through said passageways to have a Reynolds number greater than 4000.

26. The char making apparatus as claimed in claim 20, where the outer passageway between the double outer walls surrounds the rotatable drive screws moving the coal-bearing material through the pyrolyzer furnace housing.

27. The char making apparatus as claimed in claim 20, where the portion of the pyrolyzer furnace housing downstream through which the coal-bearing material moves has a decreasing cross sectional area in the direction of travel of the coal-bearing material through the pyrolyzer furnace housing to compact the char before exiting the pyrolyzer furnace housing.

28. The char making apparatus as claimed in claim 27, the pyrolyzer furnace housing having a tapered outer wall downstream forming a decreasing cross-sectional area of the portion of the pyrolyzer furnace housing through which the coal-bearing material moves in the direction of travel of the coal-bearing material through the pyrolyzer furnace housing to compact the char before exiting the pyrolyzer furnace housing.

29. The char making apparatus as claimed in claim 28, where the hollow drive shaft through each screw has a tapered outer wall decreasing the cross sectional area of the portion of the pyrolyzer furnace housing through which the coal-bearing material moves in the direction of travel of the coal-bearing material through the pyrolyzer furnace housing to compact the char before exiting the pyrolyzer furnace housing.

30. The char making apparatus as claimed in claim 28, where the pyrolyzer furnace housing has tapered inner walls and the hollow drive shafts of the drive screws have tapered outer walls coordinated to decrease the cross sectional area of the portion of the pyrolyzer furnace housing through which the coal-bearing material moves in the direction of travel of the coal-bearing material through the pyrolyzer furnace housing to compact the char before exiting the pyrolyzer furnace housing.

31. The char making apparatus as claimed in claim 20, where the char making apparatus is capable of heating volatile materials and coal in the coal-bearing material to a temperature in a range of 650° F. to 1300° F.

32. The char making apparatus as claimed in claim 20, where the pyrolyzer furnace housing is capable of being inclined at a variable upwardly angle in the direction of movement of the coal-bearing material through the housing.

33. The char making apparatus as claimed in claim 20, where at least three drive screws are laterally positioned within the pyrolyzer furnace housing, the drive screws being positioned such that each screw interleaves at least one other screw.

34. The char making apparatus as claimed in claim 20, comprising in addition at least one clearing screw having a smaller diameter positioned longitudinally through the furnace housing adjacent the drive screws and capable of conveying coal-bearing materials from the drive screws through the pyrolyzer furnace housing.

35. The char making apparatus as claimed in claim 20, comprising in addition at least one clearing screw having a smaller diameter positioned longitudinally through the furnace housing adjacent the drive screws and capable of conveying coal-bearing materials from the drive screws through the pyrolyzer furnace housing.

36. The char making apparatus as claimed in claim 20, where the pyrolyzer furnace housing comprises at least two zones along its length, where the first zone is capable of fluidizing volatile materials, and the second zone is capable of mixing supplemental materials into the coal-bearing materials, and plasticizing coal in the coal-bearing material in the second or subsequent zone.

37. The char making apparatus as claimed in claim 20, where the pyrolyzer furnace housing comprises at least two zones along its length, where the first zone is capable of fluidizing volatile materials, and at least one of the subsequent zones is capable of plasticizing coal in the coal-bearing material.

* * * * *